US012551026B2

(12) United States Patent
Toratani

(10) Patent No.: US 12,551,026 B2
(45) Date of Patent: Feb. 17, 2026

(54) SUPINE RESPIRATION MAT

(71) Applicant: TORATANI CO., LTD., Ishikawa (JP)

(72) Inventor: Ikuo Toratani, Ishikawa (JP)

(73) Assignee: TORATANI CO., LTD., Ishikawa (JP)

( * ) Notice: Subject to any disclaimer, the term of this patent is extended or adjusted under 35 U.S.C. 154(b) by 187 days.

(21) Appl. No.: 18/282,048

(22) PCT Filed: Jan. 20, 2022

(86) PCT No.: PCT/JP2022/002031
§ 371 (c)(1),
(2) Date: Sep. 14, 2023

(87) PCT Pub. No.: WO2022/209191
PCT Pub. Date: Oct. 6, 2022

(65) Prior Publication Data

US 2024/0164540 A1 May 23, 2024

(30) Foreign Application Priority Data

Apr. 1, 2021 (WO) ..... PCT/JP2021/014149

(51) Int. Cl.
*A47C 27/14* (2006.01)

(52) U.S. Cl.
CPC ..... *A47C 27/146* (2013.01)

(58) Field of Classification Search
CPC ..... A47C 27/146; A47C 27/144; A61G 7/00; A61G 7/05; A61G 7/05707; A61G 7/07; A61G 7/05723
See application file for complete search history.

(56) References Cited

U.S. PATENT DOCUMENTS 1,617,593 A * 2/1927 Hardy ..... A61H 23/02 601/97
3,146,469 A * 9/1964 Slade ..... A47C 27/15 5/699

(Continued)

FOREIGN PATENT DOCUMENTS

GB 2499630 8/2013
JP 6-58762 8/1994

(Continued)

OTHER PUBLICATIONS

International Search Report issued Mar. 22, 2022 in International (PCT) Application No. PCT/JP2022/002031.

(Continued)

*Primary Examiner* — Fredrick C Conley
(74) *Attorney, Agent, or Firm* — Wenderoth, Lind & Ponack, L.L.P.

(57) ABSTRACT

A mat includes a back support part. The back support part includes: a spine support part configured to continuously support three or more continuous lumbar vertebrae and thoracic vertebrae and including a first lumbar vertebra to a twelfth thoracic vertebra of a spine of a person's body in a supine position; and serratus posterior inferior muscle corresponding parts which are on respective sides of the spine support part and below a portion configured to correspond to left and right serratus posterior inferior muscles of the person's body in the supine position. The serratus posterior inferior muscle corresponding parts and the spine support part are configured such that a first body pressure from the serratus posterior inferior muscle corresponding parts is lower than a second body pressure from the spine support part.

19 Claims, 14 Drawing Sheets

(56) References Cited

U.S. PATENT DOCUMENTS

| | | | | | |
|---|---|---|---|---|---|
| 3,626,526 | A | * | 12/1971 | Viel | A47C 27/148 5/722 |
| 3,795,018 | A | * | 3/1974 | Broaded | A61G 7/05723 5/613 |
| 4,335,476 | A | * | 6/1982 | Watkin | A47C 27/146 5/730 |
| 4,665,573 | A | * | 5/1987 | Fiore | A47C 27/148 5/731 |
| 8,661,591 | B1 | * | 3/2014 | Sonderland | A47C 27/146 5/733 |
| 9,724,257 | B1 | * | 8/2017 | Chen | A61G 7/165 |
| 10,357,115 | B2 | | 7/2019 | Oh | |
| 2003/0014818 | A1 | | 1/2003 | Fuhriman | |
| 2005/0115003 | A1 | | 6/2005 | Torbet et al. | |
| 2014/0237728 | A1 | | 8/2014 | Oh | |
| 2015/0082550 | A1 | | 3/2015 | Hui | |
| 2018/0168361 | A1 | | 6/2018 | Patmore et al. | |
| 2019/0290014 | A1 | | 9/2019 | Oh | |
| 2020/0113349 | A1 | | 4/2020 | Oh | |

FOREIGN PATENT DOCUMENTS

| | | |
|---|---|---|
| JP | 2002-119382 | 4/2002 |
| JP | 2007-136049 | 6/2007 |
| JP | 2016-506797 | 3/2016 |
| JP | 2018-86434 | 6/2018 |

OTHER PUBLICATIONS

Extended European Search Report issued Aug. 26, 2024 in European Patent Application No. 22779421.1.

* cited by examiner

SUPINE RESPIRATION MAT

TECHNICAL FIELD

The present invention relates to a mat, and more particularly, to a mat that enables promotion of respiration in a supine position.

BACKGROUND ART

There are mats which are used to support a person's body when the person lies down on the body. This type of mat is required to have a function of making a person lying on the mat feel comfortable to sleep.

Sleeping comfort of the mat depends on balance between repulsive force of the mat and body pressure of a person lying on the mat. The body pressure is pressure applied to the mat by the person lying on the mat, and its distribution varies depending on posture of the body of the person. For example, the body pressure in a supine position is highest in the buttocks. When the mat supports the entire body of a person in the supine position, the mat having uniformly high repulsive force causes the body pressure to concentrate on the buttocks and the back. Thus, the buttocks and the back are likely to be congested. Accordingly, tossing and turning to eliminate congestion increase, and thus sleep tends to be shallow. Conversely, the mat having uniformly low repulsive force causes the buttocks to sink into the mat deepest. Accordingly, the backbone in the supine position is greatly distorted from an S-shape in an upright state, thereby causing low back pain and a round-shouldered posture.

Known examples of a device for improving sleeping comfort include a mat in which repulsive force or a surface shape is changed depending on a place in a direction of the backbone of a person in the supine position (e.g., see Patent Literatures 1 to 3). These mats include regions in contact with the buttocks and the back, the regions being set to be softer or lower than other regions. Accordingly, the body pressure concentrated on the buttocks and the back is dispersed to other portions. Thus, the body pressure approaches uniform in the entire mat, so that the backbone in the supine position can be brought close to the same S-shape as that in the upright state.

A degree of sleeping comfort relates to not only the number of times of tossing and turning, and a shape of the backbone, but also a depth of respiration. Deeper respiration during sleep causes the sleep to be more comfortable. However, even when the body pressure is brought close to uniform in the entire mat as described above, respiration in the supine position is liable to become shallow. Thus, there is room for improvement in promoting the respiration.

CITATION LIST

Patent Literature

Patent Literature 1: JP H06-058762 U
Patent Literature 2: JP 2002-119382 A
Patent Literature 3: JP 2016-506797 A

SUMMARY OF INVENTION

The present invention has been made in view of the above circumstances, and an object of the present invention is to provide a mat that enables promotion of respiration in a supine position.

A mat according to the present invention includes a back support part that supports a back of a person in a supine position, in which the back support part includes: a spine support part that continuously supports a portion conforming to a section defined by three or more continuous lumbar vertebrae and thoracic vertebrae of a spine in the back of the person in the supine position, the section including at least a first lumbar vertebra and a twelfth thoracic vertebra; and a pair of serratus posterior inferior muscle corresponding parts which are respectively disposed on widthwise both sides of the spine support part and disposed below portions conforming to a pair of left and right serratus posterior inferior muscles of the person in the supine position, and the pair of serratus posterior inferior muscle corresponding parts and the spine support part are configured such that a body pressure from the pair of serratus posterior inferior muscle corresponding parts is lower than a body pressure from the spine support part.

DESCRIPTION OF EMBODIMENTS

Hereinafter, a preferred embodiment of the present invention will be described in detail with reference to the accompanying drawings.

Outline Description of Mat 1

FIGS. 1 to 4 each illustrate a mat 1 that is integrally made of an elastic material such as urethane in a thin rectangular parallelepiped shape. The mat 1 constitutes a bed together with a frame or a table (not illustrated) that supports the mat 1. For example, the mat 1 has a size enough to support the whole body of a person 50 (see FIGS. 5 to 7) in a supine position on the mat 1 with the entire upper surface of the mat 1. The size of mat 1 is set in accordance with a standard adult body shape (e.g., Japanese adult male having a height of 170 cm and a weight of about 70 kg, or the like), for example. The mat 1 in the present invention is only required to have a size enough to support at least a portion conforming to a back 52 (see FIGS. 5 to 7) of the person 50 in the supine position.

In the specification and drawings of the present application, directions are defined as a direction X (head side X1 and leg side X2) in which the body of the person 50 in the supine position extends, a width direction Y (right side Y1, left side Y2) of the person 50 in the supine position, and a vertical direction Z (upper side Z1, lower side Z2) of the mat 1.

Figure 1:
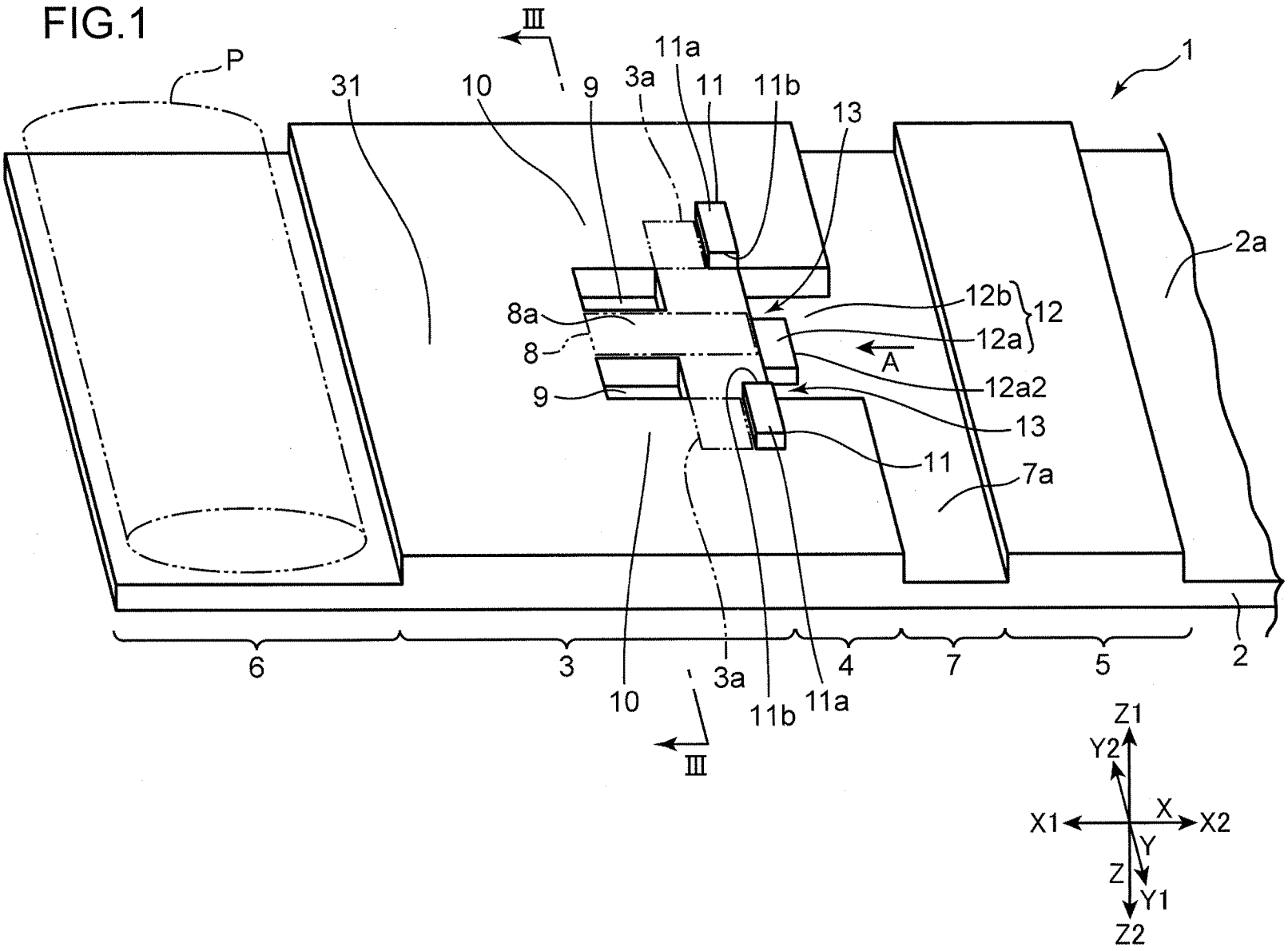
FIG. 1 is a perspective view illustrating a general configuration of a mat according to an embodiment of the present invention.

The mat 1 has a shape protruding toward the upper side Z1, and coming into contact with the back 52, a pelvis PV, and legs of the person 50 in the supine position. Specifically, the mat 1 includes a base part 2 having a flat rectangular parallelepiped shape, and three parts protruding toward the upper side Z1 from an upper surface 2*a* of the base part 2, that is, a back support part 3, a pelvis support part 4, and a leg support 5. The back support part 3 supports the back 52 (see FIGS. 5 to 7) of the person 50 in the supine position. The pelvis support part 4 is located on the leg side X2 with respect to the back support part 3 and supports a portion conforming to the pelvis PV (see FIGS. 5 to 6). The leg support 5 is located on the leg side X2 with respect to the pelvis support 4, and supports a portion conforming to a section near the femur FM (see FIGS. 5 to 6) of the leg. As illustrated in FIG. 1, most of the back support part 3, the pelvis support 4, and the leg support 5 are equal in height, but a pair of serratus posterior inferior muscle corresponding parts 9 of the back support part 3 and a sacrum corresponding part 12 of the pelvis support 4 are lower than other parts, and further, a pair of ilium support parts 11 of the pelvis support 4 is higher than the other parts.

The mat 1 includes a region on the head side X1 with respect to the back support part 3, the region being formed as a head placement region 6 in which a head 51 (see FIG. 5) is disposed. The head placement region 6 allows the upper surface 2*a* of the base part 2 to be exposed, and a pillow P that supports the head 51 to be disposed.

The mat 1 includes the pelvis support 4 and the leg support 5 between which a hip joint placement region 7 is formed having a recess 7*a* in which a hip joint J2 (see FIGS. 5 to 6) is to be disposed. The hip joint J2 is not pressed by the mat 1 by being accommodated in the recess 7*a* when the person 50 is in a supine position, so that the hip joint J2 does not interfere with movement in the width direction Y of a pair of hipbones HB described later.

Although the pelvis support 4 (specifically, an ilium support 11 to be described later) and the leg support 5 are crushed by the weight of the person 50 in the supine position, the recess 7*a* is not crushed in the supine position, and thus causing the hip joint J2 to be in a non-supporting state. Thus, the recess 7*a* has a depth set to an extent that allows the recess 7*a* not to be crushed by weight of the person 50. Instead of forming the recess 7*a*, even the hip joint placement region 7 equal in height to the pelvis support 4 and the leg support 5 and made of a material having low hardness enables avoiding compression on the hip joint J2.

(Description of Back 52)

Figure 8:
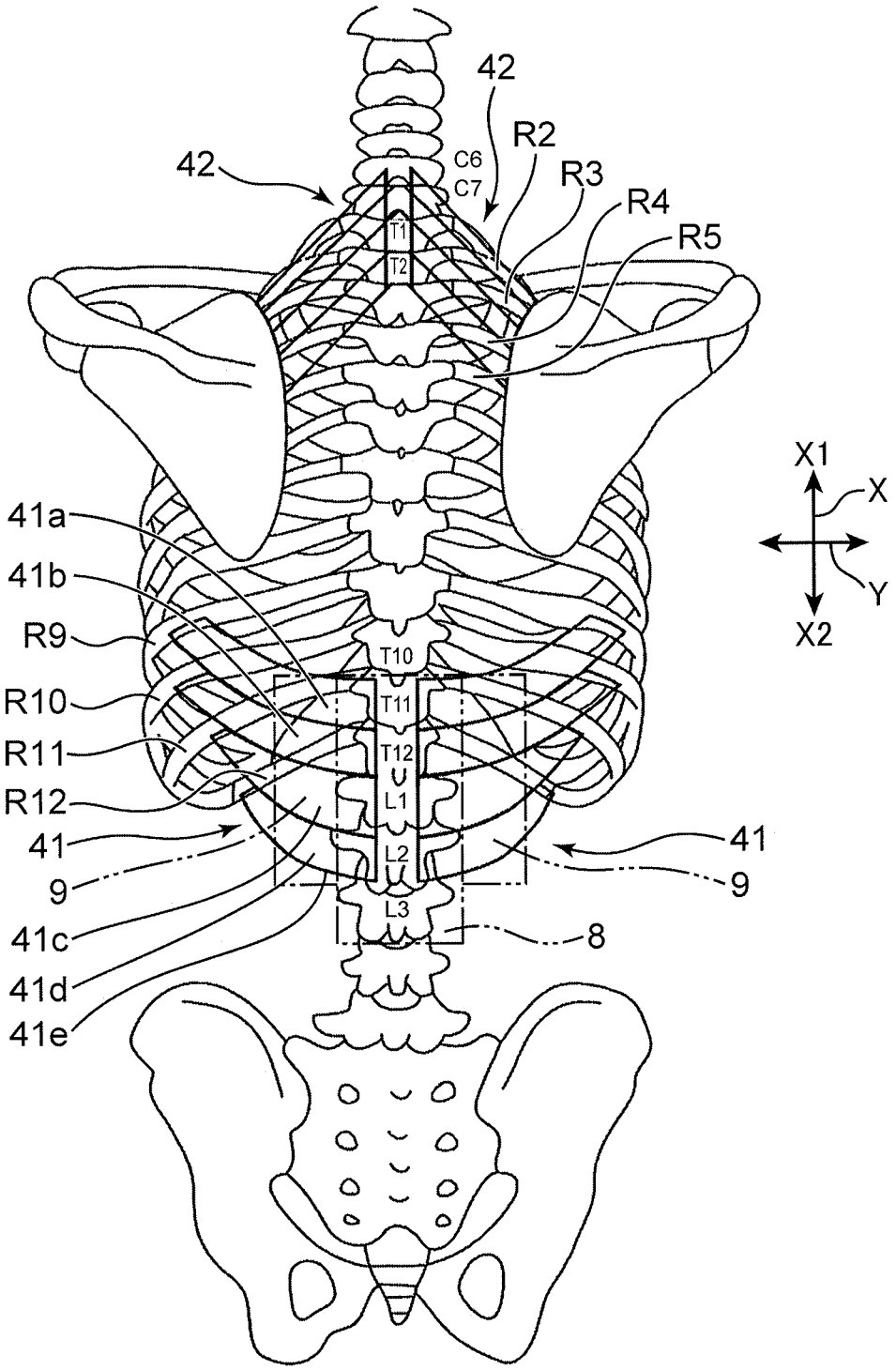
FIG. 8 is an explanatory diagram schematically illustrating placement of serratus posterior inferior muscle and superior posterior serratus muscle of a person, and a serratus posterior inferior muscle corresponding part of the mat of FIG. 1.

As illustrated in FIG. 8, the back 52 to be supported by the back support part 3 includes inside a pair of serratus posterior inferior muscles 41 and a pair of superior posterior serratus muscles 42 as muscles that control respiration of the person 50 in the supine position.

Each of the pair of serratus posterior inferior muscles 41 is disposed on corresponding one of both left and right sides across a lower part of a spine. Each serratus posterior inferior muscle 41 includes four parts 41*a* to 41*d*. The four parts 41*a* to 41*d* of the serratus posterior inferior muscle 41 connect an eleventh thoracic vertebra T11 to a second lumbar vertebra L2 (i.e., the eleventh thoracic vertebra T11, a twelfth thoracic vertebra T12, a first lumbar vertebra L1, and a second lumbar vertebra L2) and a ninth rib R9 to a twelfth rib R12, respectively.

Each of the pair of superior posterior serratus muscles 42 is disposed on corresponding one of both left and right sides across an upper part of the spine. Each superior posterior serratus muscle 42 connects a sixth cervical vertebra C6 to a second thoracic vertebra T2 and a second rib R2 to a fifth rib R5, respectively.

Figure 6:
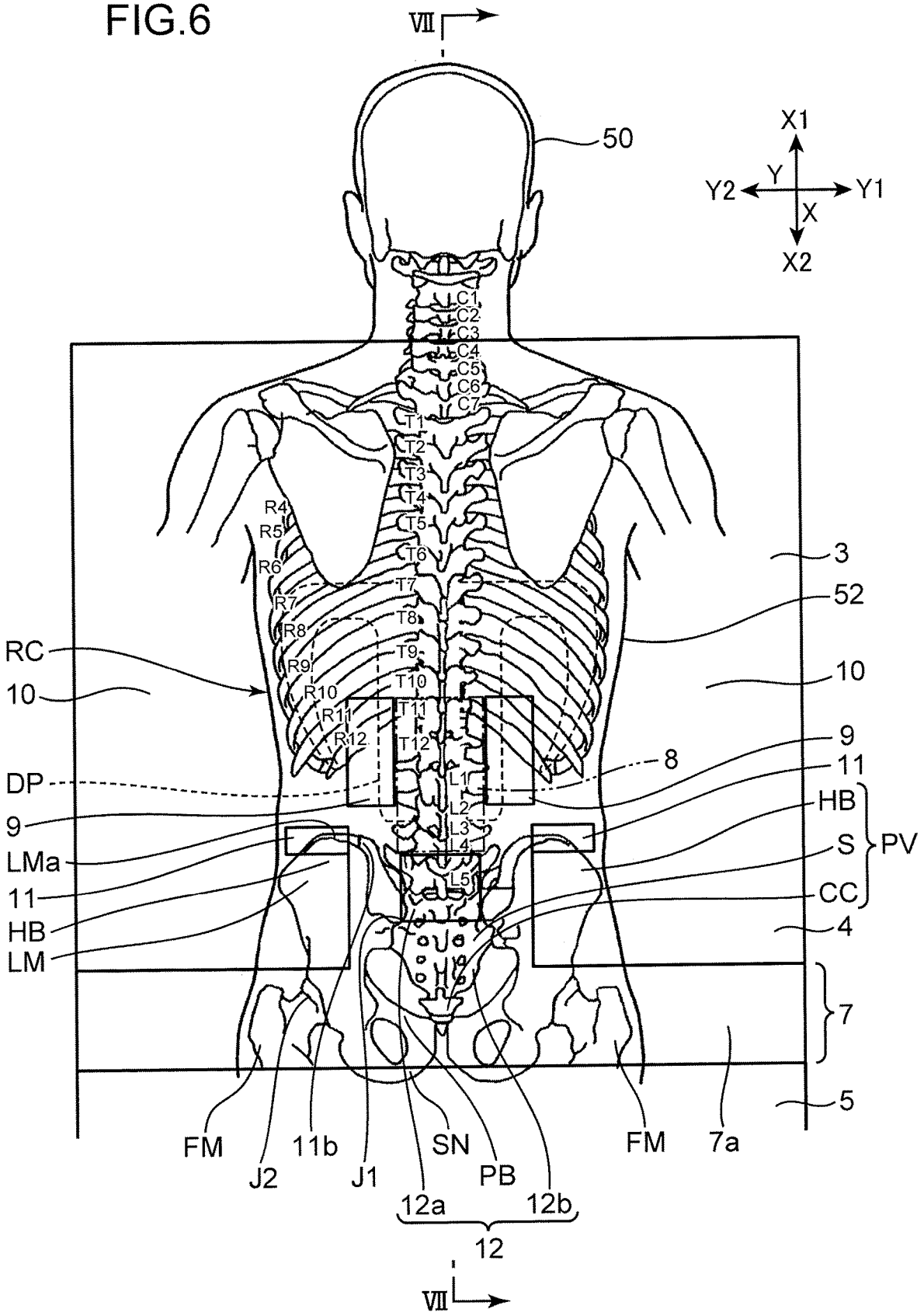
FIG. 6 is a rear view of a mat and a person schematically illustrating a relative positional relationship between the mat of FIG. 1 and a skeleton of a person in a supine position.

During respiration, a group of twelve pairs of ribs forming a rib cage during the respiration moves to assist up-and-down movement of a diaphragm DP (see FIG. 6). Specifically, during expiration, the group of the ribs forming the rib cage is pulled down by contraction of the serratus posterior inferior muscle 41 to narrow the rib cage. During inspiration, the group of the ribs is pulled up by contraction of the superior posterior serratus muscle 42 to expand the rib cage. The ribs are connected by intercostal muscles, so that the entire group of the ribs performs the up-and-down movement.

The mat 1 of the present embodiment includes the back support part 3 with a structure below preventing pulling down of the group of the ribs due to the serratus posterior inferior muscle 41 from being restricted in the supine position.

(Description of Back Support Part 3)

As illustrated in FIGS. 1 to 8, the back support part 3 includes: a spine support part 8 that continuously supports a portion conforming to a section defined by three or more continuous lumbar vertebrae and thoracic vertebrae and including at least a first lumbar vertebra L1 to a twelfth thoracic vertebra T12 of the spine in the back 52 of the person 50 in the supine position; and the pair of serratus posterior inferior muscle corresponding parts 9 each of which is disposed on corresponding one of both sides of the spine support part 8 in the width direction Y and disposed below a portion conforming to one of a pair of left and right serratus posterior inferior muscles 41 of the person 50 in the supine position. The spine support part 8 is disposed at an intermediate position in the width direction Y of the mat 1 and extends in a height direction X. Each of the pair of serratus posterior inferior muscle corresponding parts 9 is disposed on corresponding one of both sides in the width direction Y across the spine support part 8 and extends in the height direction X.

Figure 7:
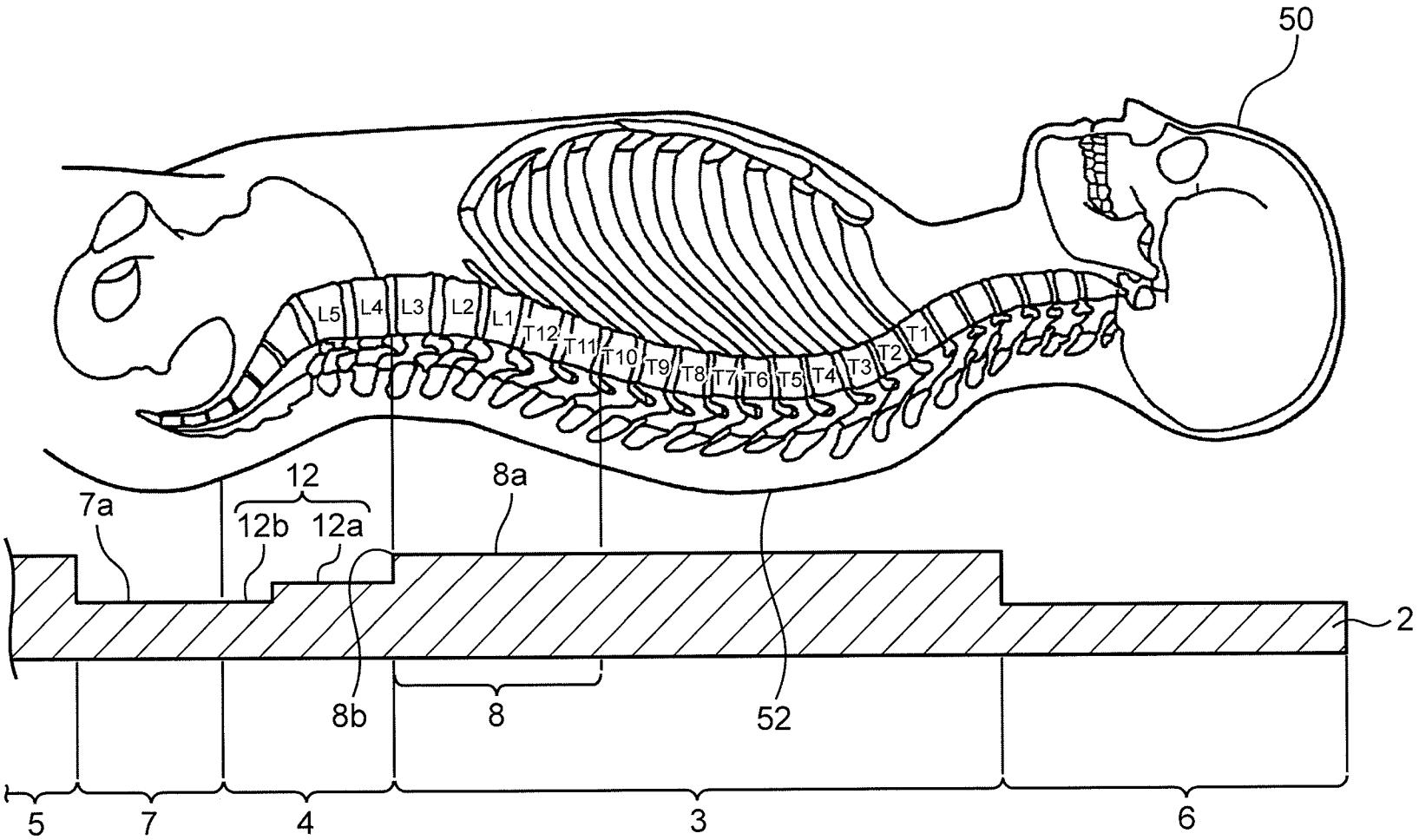
FIG. 7 is a longitudinal sectional view of the mat and a person schematically illustrating a relative positional relationship between the mat of FIG. 1 and a skeleton of a person in a supine position.

As illustrated in FIGS. 1 and 7, the spine support part 8 of the present embodiment extends to a position of an end of a sacrum support part 12*a* described later, the end being close to the head. The spine support part 8 includes an upper surface 8*a* that continuously extends to a leg side edge 8*b*, the upper surface 8*a* being capable of supporting a section up to a third lumbar vertebra L3.

The spine support part 8 is only required to have a length (a length in the direction X in which the body extends) that enables continuously supporting a portion conforming to a section defined by three or more continuous lumbar vertebrae and thoracic vertebrae and including at least the first lumbar vertebra L1 and the twelfth thoracic vertebra T12 of the spine in the back 52 of the person 50 in the supine position. Although FIGS. 6 to 8 each illustrate the spine support part 8 having a length enough to continuously support the portion conforming to the third lumbar vertebra L3 to the eleventh thoracic vertebra T11 of the spine, the length may be within a region in which four lumbar vertebrae and four thoracic vertebrae are continuous, such as a region from the third lumbar vertebra L3 to the twelfth thoracic vertebra T12 or a region from the second lumbar vertebra L2 to the eleventh thoracic vertebra T11, or within a region in which three lumbar vertebrae and three thoracic vertebrae are continuous from the first lumbar vertebra L1 to the eleventh thoracic vertebra T11.

The continuous support using the spine support part 8 is only required to individually support each of the lumbar vertebrae and the thoracic vertebrae in the above region. Thus, the spine support part 8 is not limited to a shape continuously extending in the direction X in which the body extends, and may have a shape that is intermittently interrupted without a gap corresponding to one or more of each of the lumbar vertebra and the thoracic vertebra.

Figure 2:
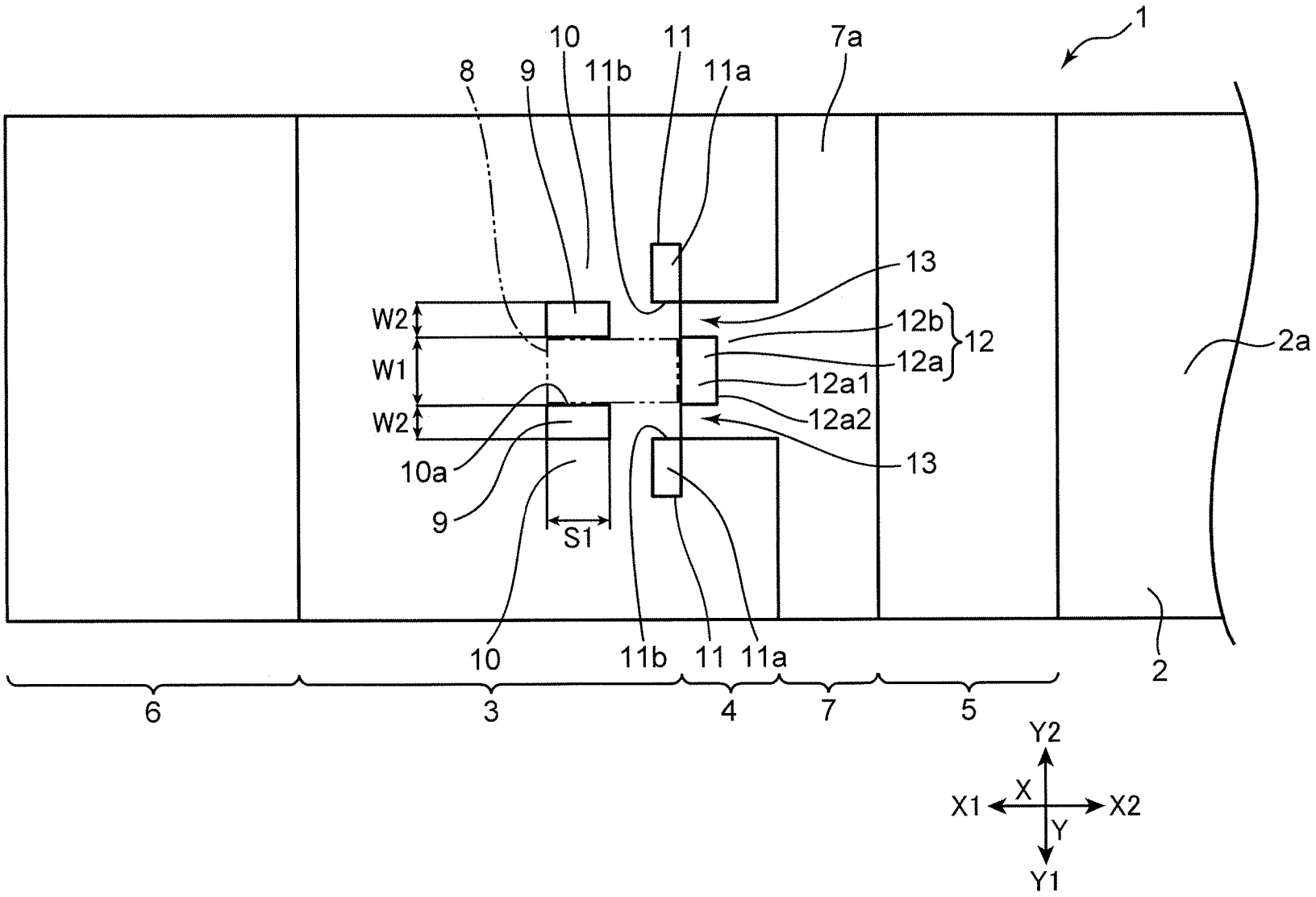
FIG. 2 is a plan view of the mat of FIG. 1.
Figure 3:
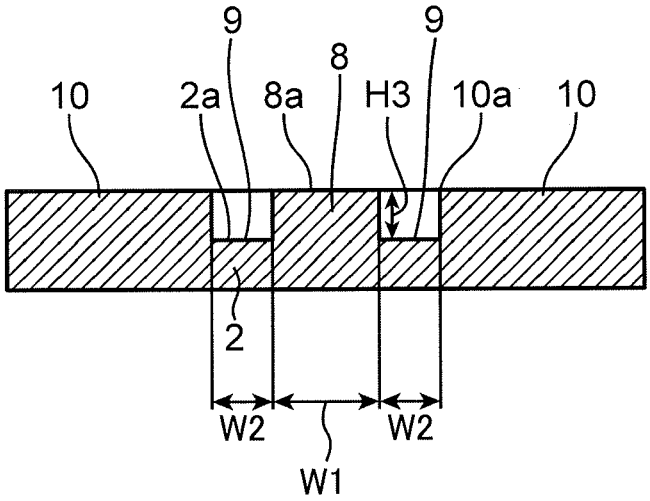
FIG. 3 is a sectional view of the mat of FIG. 1 taken along line III-III.

The spine support part 8 illustrated in FIGS. 2 and 3 has a width W1 set within a region of a portion conforming to a section defined by three or more continuous lumbar vertebrae and/or thoracic vertebrae and including at least the first lumbar vertebra L1 and the twelfth thoracic vertebra T12. In other words, although the width W1 of the spine support part 8 is set in a region in which the spine support part 8 is in contact with a portion conforming to a section defined by three or more continuous lumbar vertebrae and/or thoracic vertebrae and including at least the first lumbar vertebra L1 and the twelfth thoracic vertebra T12, the width W1 does not allow the spine support part 8 to be in contact with and press on a portion conforming to the ribs R9 to R12 extending from the thoracic vertebrae T9 to T12, respectively, to both left and right sides (both sides in the width direction Y).

Specifically, the width W1 of the spine support part 8 is preferably set in a region of 4 cm to 11 cm (preferably, about 9 cm) based on the standard Japanese adult body shape. The width W1 less than 4 cm may cause a problem that the portion conforming to the lumbar vertebrae and the thoracic vertebrae is supported by a too small area to maintain interlocking movement of the lumbar vertebrae and thoracic vertebrae. In contrast, the width W1 larger than 11 cm may cause a problem that the spine support part 8 presses not only the lumbar vertebrae and the thoracic vertebrae but also the ribs on both sides of the thoracic vertebrae to inhibit exhalation. Thus, the width W1 of the spine support part 8 is preferably set in the region of 4 cm to 11 cm as described above as a region in which the ribs are not compressed while interlocking properties between the lumbar vertebrae and the thoracic vertebrae are maintained.

The pair of serratus posterior inferior muscle corresponding parts 9 and the spine support part 8 are configured such that body pressure from the serratus posterior inferior muscle corresponding parts 9 is lower than body pressure from the spine support part 8. The serratus posterior inferior muscle corresponding part 9 in the present embodiment includes a recess formed in a surface of the back support part 3, the recess reducing the body pressure from the serratus posterior inferior muscle corresponding part 9. The recess includes inner surfaces (specifically, a bottom surface and an inner peripheral surface of the recess) that form a space reducing compression on a portion conforming to the serratus posterior inferior muscle 41 in the back.

As illustrated in FIG. 3, the recess constituting the serratus posterior inferior muscle corresponding part 9 includes a bottom formed of the upper surface 2*a* of the base part 2. The recess has a depth equal to a height H3 of the spine support part 8 with respect to the upper surface 2*a*. The height H3 (i.e., the depth of the recess constituting the serratus posterior inferior muscle corresponding part 9) of the spine support part 8 is set to a height enough to maintain a relationship in which the body pressure from the pair of serratus posterior inferior muscle corresponding parts 9 is lower than the body pressure from the spine support part 8 even when the spine support part 8 has sank in the supine position. The recess constituting the serratus posterior inferior muscle corresponding part 9 is only required to have a depth enough to maintain a relationship in which the body pressure from the serratus posterior inferior muscle corresponding part 9 is lower than the body pressure from the spine support part 8. Thus, although the recess preferably has a depth preventing the back of a person from touching the bottom surface of the recess in the supine position, the recess may have a depth enough to maintain the above-described relationship even when the back touches the bottom surface.

Here, the body pressure from each of the spine support part 8 and the serratus posterior inferior muscle corresponding part 9 is measured by an existing body pressure measuring machine, for example. A body pressure measuring device measures a load for each of squares as the body pressure, the squares being acquired by dividing a region on the mat 1 in a matrix shape. Using this body pressure measuring device enables acquiring the body pressure from each of the spine support part 8 and the serratus posterior inferior muscle corresponding part 9 as, for example, an average value of the body pressure applied from the spine support part 8 to a region of the portion conforming to the lumbar vertebrae and the thoracic vertebrae, and an average value of the body pressure applied from the serratus posterior inferior muscle corresponding part 9 to a region of the portion conforming to the serratus posterior inferior muscle 41.

As illustrated in FIG. 8, when each of the serratus posterior inferior muscle corresponding parts 9 is formed in a region including at least a locality of a portion conforming to the section 41*d* connected to the second lumbar vertebra L2 in the corresponding one of the pair of serratus posterior inferior muscles 41 (a locality intermediate in width of the portion in FIG. 8), compression on the locality most contributing to the pulling down of the group of the ribs can be reliably avoided.

As illustrated in FIG. 8, each of the pair of serratus posterior inferior muscle corresponding parts 9 in the present embodiment is formed in a region of ½ or more (preferably ¾ or more) of an area that is acquired by projecting each of the pair of serratus posterior inferior muscles 41 on the upper surface of the mat 1, each of the pair of serratus posterior inferior muscles 41 including a portion conforming to a section connected to the second lumbar vertebra L2. This configuration enables a section of the serratus posterior inferior muscle 41 to be more reliably prevented from being compressed, the section greatly contributing to pulling down the group of the ribs forming the rib cage in the serratus posterior inferior muscle 41. For example, the serratus posterior inferior muscle corresponding part 9 illustrated in FIG. 8 is formed in a region from the second lumbar vertebra L2 to the eleventh thoracic vertebra T11 in the direction X in which the body extends, and covering a section intermediate in width of the serratus posterior inferior muscle 41 in the width direction Y. This configuration enables the serratus posterior inferior muscle corresponding part 9 to cover a region of ½ or more of an area acquired by projecting each of the pair of serratus posterior inferior muscles 41 on the upper surface of the mat 1. The serratus posterior inferior muscle corresponding part 9 formed in a region covering an outer end part of the tenth rib R10 in the width direction Y enables covering a region of ¾ or more of the area acquired by projecting each of the pair of serratus posterior inferior muscles 41 on the upper surface of the mat 1. The serratus posterior inferior muscle corresponding part 9 is only required to have a width W2 (length in the width direction Y) enough to cover ½ or more of the section 41*d* in width, the section 41*d* being connected to the second lumbar vertebra L2 in the serratus posterior inferior muscle 41. For example, when the spine support part 8 has the width W1 of 8 cm, the width W2 of the serratus posterior inferior muscle corresponding part 9 is set in a region of 4 cm to 12 cm. Additionally, the serratus posterior inferior muscle corresponding part 9 is only required to have a length S1 (length in the height direction X) enough to cover a section intermediate in width of the serratus posterior inferior muscle 41, and the length S1 is preferably set to, for example, about 10 cm (region of about 8 cm to 15 cm) when a standard Japanese adult body shape is used as a reference.

As illustrated in FIGS. 1 to 3 and 6, the back support part 3 further includes a pair of outer support parts 10 located outward in the width direction Y from the corresponding one of the pair of serratus posterior inferior muscle corresponding parts 9. The pair of outer support parts 10 supports at least an outer part of the back 52, the outer part being outside the serratus posterior inferior muscle 41 in the width direction Y. The outer support 10 in the present embodiment supports not only the outer part of the back 52, the outer part being outside the serratus posterior inferior muscle 41 in the width direction Y, but also parts of the serratus posterior inferior muscle 41, the sections each being connected to corresponding one of the ninth rib R9 to the twelfth rib R12. In particular, each of the pair of outer support parts 10 includes an inner edge 10*a* located outside the serratus posterior inferior muscle corresponding part 9 in the width direction Y, and thus can support an outer part in the width direction Y of the back 52 even when the portion conforming to the serratus posterior inferior muscle 41 enters the recess constituting the serratus posterior inferior muscle corresponding part 9. Accordingly, the pair of outer support parts 10 can support the outer part in the width direction Y of the back 52 in the supine position. Additionally, the body pressure of the serratus posterior inferior muscle corresponding part 9 is set to be lower than the body pressure of each of the outer support parts 10.

(Description of Pelvis PV)

Figure 5:
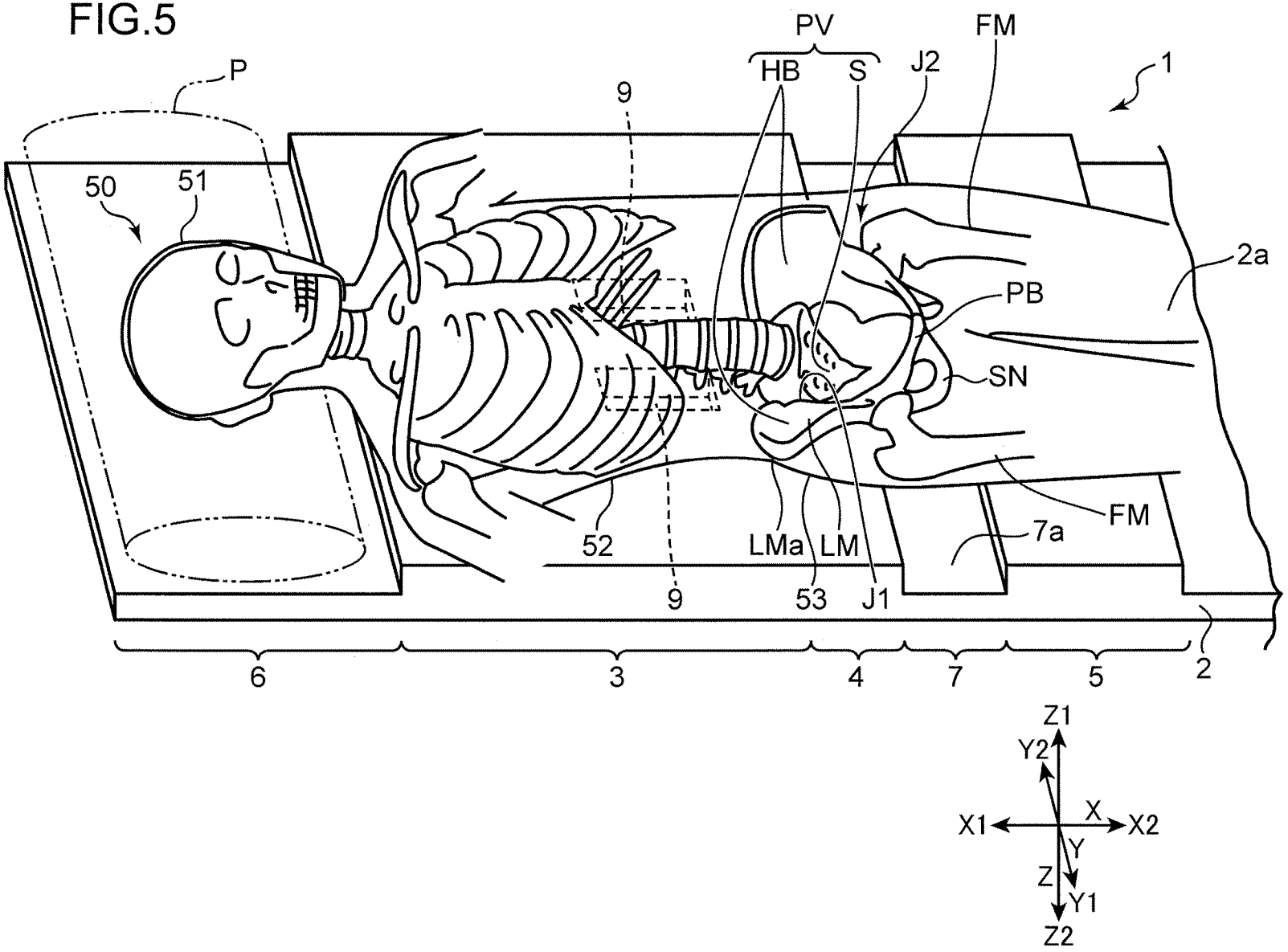
FIG. 5 is an explanatory diagram illustrating a state in which a person lies on the back on the mat of FIG. 1.
Figure 9:
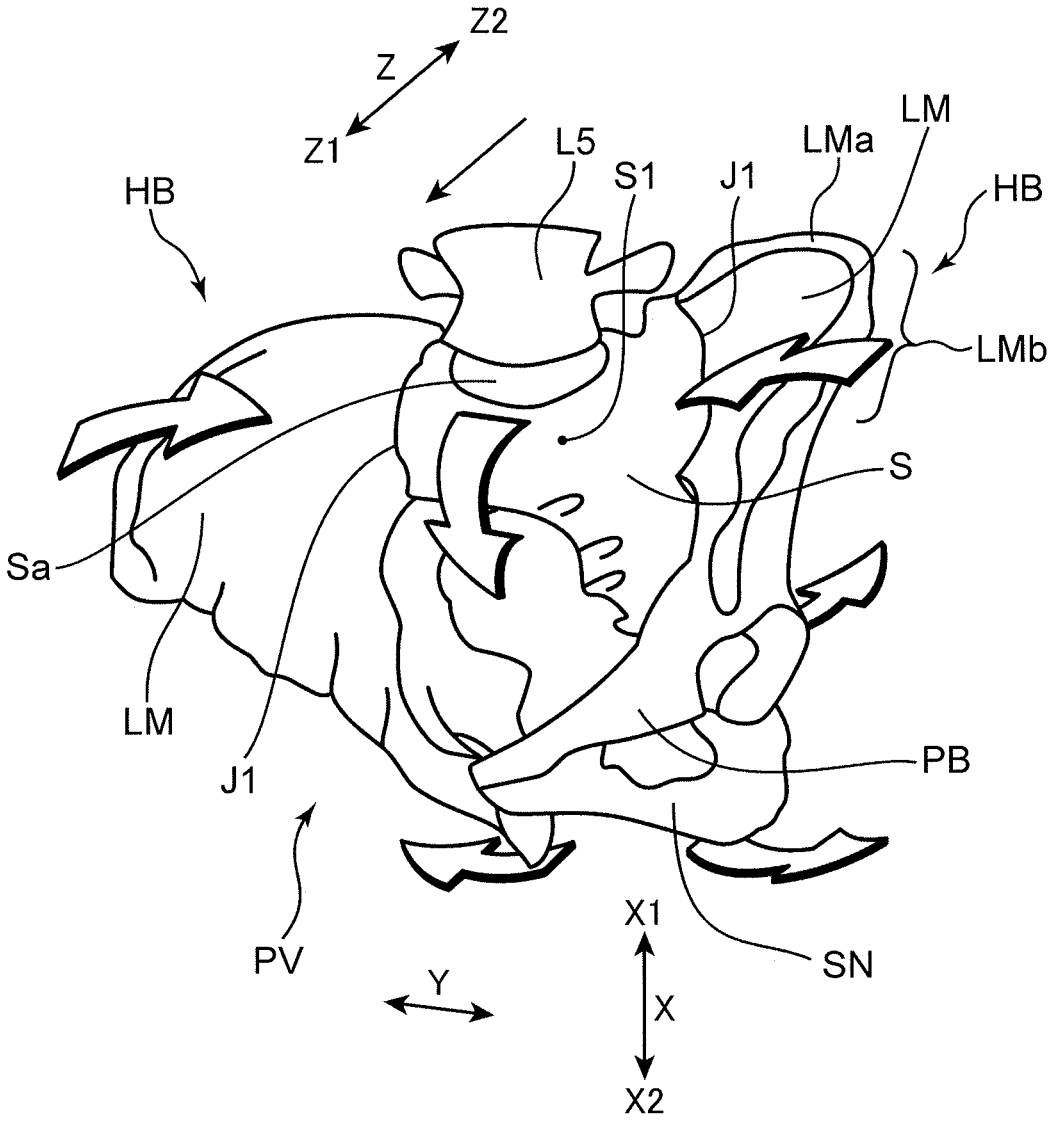
FIG. 9 is a perspective explanatory diagram of a pelvis, illustrating a nodding motion of a sacrum.

Here, the pelvis PV supported by the pelvis support 4 will be described in detail. As illustrated in FIGS. 5, 6 and 9, the pelvis PV includes a pair of hipbones HB spaced apart in the width direction Y, a sacrum S located between the pair of hipbones HB, and a coccyx CC connected to an end of the sacrum S on the leg side X2.

Each of the hipbones HB includes an ilium LM constituting a section on the head side X1, a pubis PB in an arch shape extending from an end of the ilium LM on the leg side X2 toward the front of the body (upper side Z1 in FIG. 5) and the center of the body, and an ischium SN in an arch shape curved from the ilium LM on the leg side X2 and toward the leg side X2 and connected to an end of the pubis PB, the end close to the center of the body. Each of a pair of the ilia LM is connected to the sacrum S with a sacroiliac joint J1.

As illustrated in FIGS. 5, 6 and 9, the ilium LM is a flat bone in a curved plate shape. The ilium LM is provided at its end on the head side X1 with an iliac crest LMa that is a ridge part in an arc shape curved outward in the width direction Y and forward (upper side Z1 in FIG. 5) of the body. In other words, the iliac crest LMa is an edge of the ilium LM on a side (head side X1) close to the head 51 of the person 50 in the supine position.

Detailed Description of Pelvis Support 4

The pelvis support 4 of the present embodiment is configured as follows to support a portion conforming to the pelvis PV configured as described above.

As illustrated in FIGS. 1, 2 and 4 to 7, the pelvis support 4 includes the pair of ilium support parts 11 spaced apart from each other in the width direction Y, and the sacrum corresponding part 12 with the sacrum support part 12*a* disposed between the pair of ilium support parts 11. The sacrum support part 12*a* and the ilium support parts 11 on both sides thereof are separated across a gap 13 (see FIGS. 1 and 2) in the present embodiment, so that influence of body pressure from the ilium support 11 on the sacrum S can be avoided, and a nodding motion of the sacrum S to be described later is not hindered.

Figure 10:
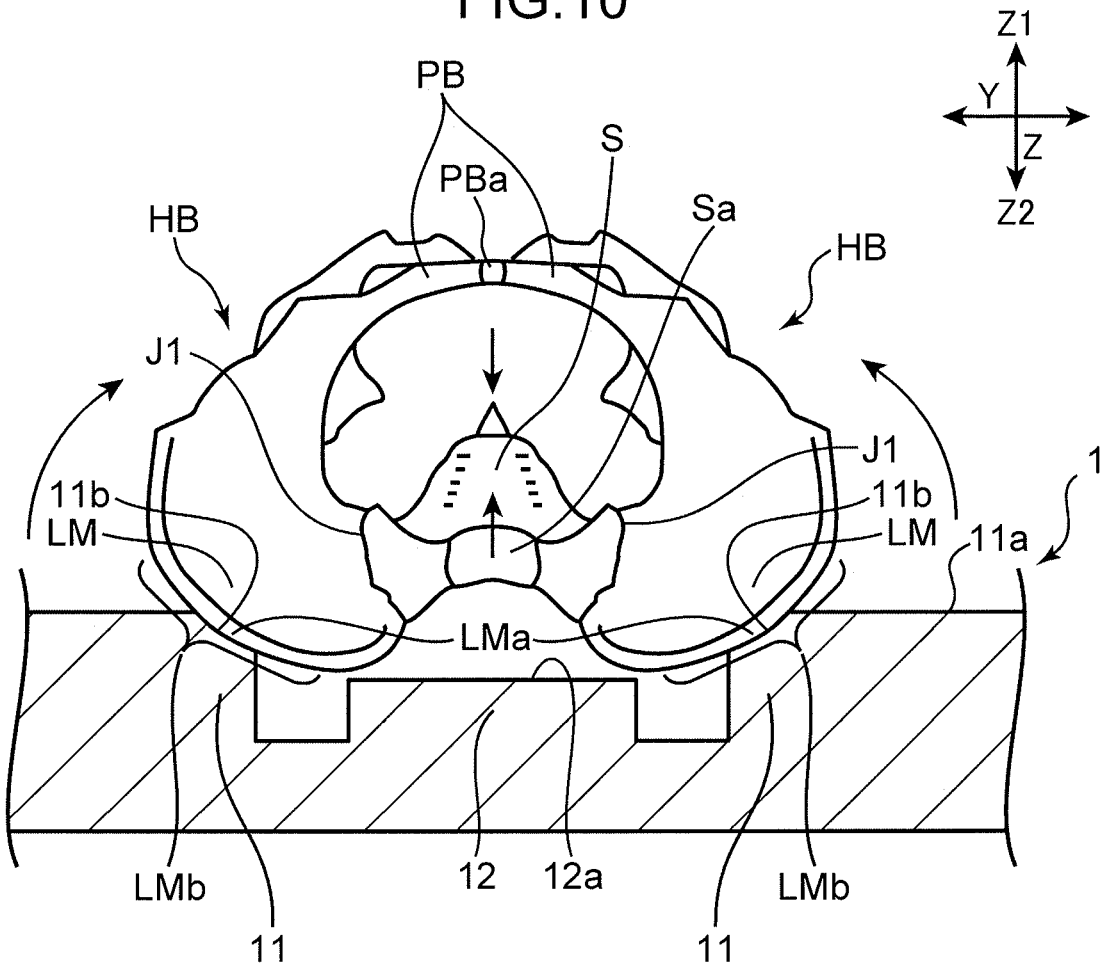
FIG. 10 is an explanatory sectional view schematically illustrating medial rotation of a pair of ilia and a nodding motion of a sacrum when a person lies on the back on the mat of FIG. 1.

Each of the pair of ilium support parts 11 is disposed at a position where the corresponding one of the pair of ilium support parts 11 can be brought into contact with a portion conforming to at least an outer section LMb (see FIG. 10) in the width direction Y of the iliac crest LMa on the lower side Z2 of corresponding one of the iliac crests LMa of the pair of ilia LM in the pelvis PV. As illustrated in FIGS. 9 and 10, the outer part LMb outward in the width direction Y of the iliac crest LMa refers to a region of the iliac crest LMa, the region facing the lower side Z2 and outward in the width direction Y. Accordingly, the pair of ilium support parts 11 can individually support portions conforming to the pair of ilia LM from the lower side Z2 as illustrated in FIG. 10. Each ilium support 11 includes a placement surface 11*a* on which the ilium LM is placed, and an inner upper edge 11*b* on the placement surface 11*a*, the inner upper edge 11*b* being close to the center of the mat 1 in the width direction Y. The placement surface 11*a* is configured by the upper surface of the ilium support 11.

Figure 4:
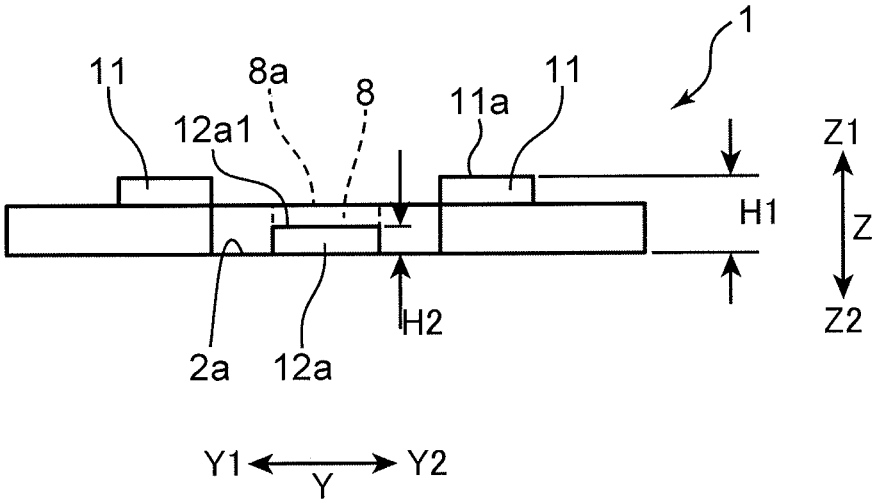
FIG. 4 is a diagram viewed along arrow A in FIG. 1.

As illustrated in FIGS. 1 and 2, the placement surface 11*a* has the shape of a flat surface having a rectangular shape in plan view. The placement surface 11*a* is disposed at a position higher than the upper surface of a peripheral part (specifically, a section 3*a* of the back support part 3 located on the head side X1 with respect to the ilium support 11) of the ilium support 11 in the back support part 3. The placement surface 11*a* may be continuous at the same height (i.e., the height H1 of the ilium support 11 and the height H3 of the spine support part 8 in FIG. 4 are equal) as upper surfaces of the spine support part 8 and the outer support 10 of the back support part 3.

For example, the placement surface 11*a* has a size set in a region in which the placement surface 11*a* can come into contact with a portion conforming to at least an outer section in the width direction Y of the iliac crest LMa of a Japanese adult male, specifically, a portion conforming to the widthwise outer section LMb of the iliac crest LMa (see FIG. 10), and does not come into contact with a site conforming to the pubis PB and the ischium SN.

Figure 11:
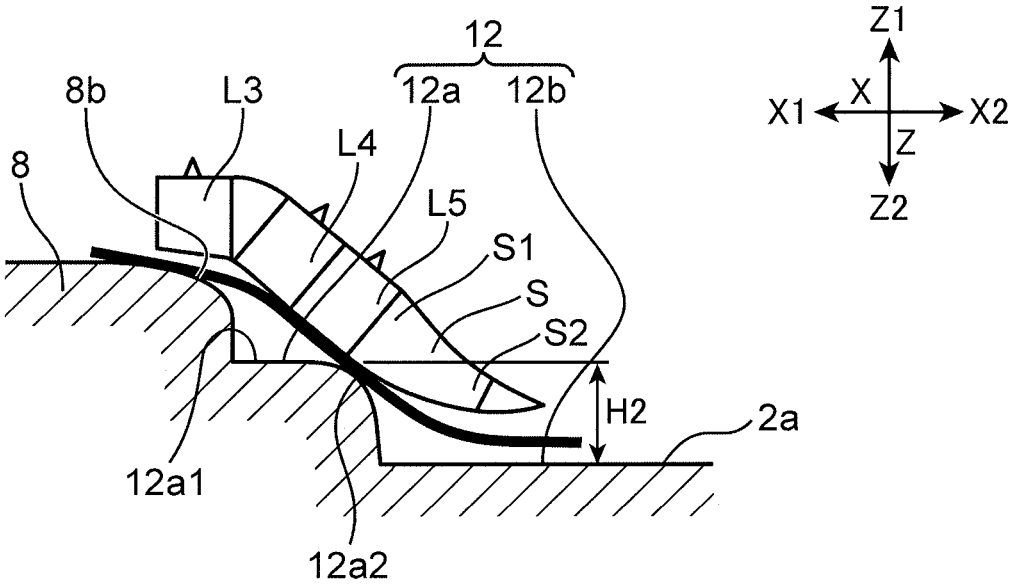
FIG. 11 is an explanatory sectional view illustrating a state in which a portion is supported by a sacrum support part, the portion conforming to a sacrum when a person lies on the back on the mat of FIG. 1.

The sacrum corresponding part 12 is disposed between the pair of ilium support parts 11 and is located on the lower side Z2 of a portion conforming to the sacrum S between the pair of ilia LM in the pelvis PV. As illustrated in FIGS. 1, 2, and 11, the sacrum corresponding part 12 includes the sacrum support part 12*a* that is set to a height 142 lower than the height H1 (see FIG. 4) of the ilium support 11 and supports a portion conforming to the section S1 on the head side X1 in the sacrum S of the person 50 in the supine position, and a sacrum non-support part 12*b* that is set to a height lower than the height H2 of the sacrum support part 12*a* and does not support a portion conforming to a section S2 on the leg side X2 in the sacrum S by being separated toward the lower side Z2 from the section S2 on the leg side X2.

The sacrum support part 12*a* supports the portion conforming to the section S1 from the lower side Z2, the section S1 being on the head side X1 in the sacrum S of the person in the supine position. The sacrum support part 12*a* has a rectangular parallelepiped shape, and includes a placement surface 12*a*1 as a top surface on which the portion conforming to the sacrum S locates. The placement surface 12*a*1 is provided at its end on the leg side X2 with a leg-side edge 12*a*2 extending in the width direction Y.

The placement surface 12*a*1 has the shape of a horizontal flat surface having a rectangular shape in plan view, and is lower than the placement surface 11*a* of the ilium support 11 and an upper surface of the spine support part 8 of the back support part 3. That is, the height H2 of the sacrum support part 12*a* is set to be relatively lower than the height H3 of the spine support part 8 as illustrated in FIG. 4. For example, the placement surface 12*a*1 has a size set in a region in which the placement surface 12*a*1 can come into contact with a portion conforming to at least the section S1 on the head side X1 of the sacrum S of a Japanese adult male, and does not come into contact with a portion conforming to the ilium LM.

When the ilium support 11 and the sacrum support part 12*a* are changed in relative height, specifically, the height H1 of the ilium support 11 is set to be relatively higher than the height 142 of the sacrum support part 12*a* as illustrated in FIG. 4.

Each of the spine support part 8 and the leg support 5 of the back support part 3 in the present embodiment has a height that is set to be equal to the height of the ilium support 11. That is, the height H1 of the ilium support 11 is set to be higher than the height H3 of the spine support part 8 and the leg support 5 as illustrated in FIG. 4.

However, the present invention is not limited thereto, and the ilium support 11 may be set to be equal in height to the back support part 3 and the leg support 5.

Additionally, the height H2 of the sacrum support part 12*a* is set to a height enough to support the portion conforming to the sacrum S with body pressure applied from the sacrum support part 12*a* to the portion conforming to the sacrum S, the body pressure being lower than body pressure applied from the ilium support 11 to the portion conforming to the ilium LM.

(Description of Relationship Between Expiration and Nodding Motion of Sacrum S)

Although respiration is unconsciously performed during sleep as natural respiration, how much the natural respiration is performed is important. Expiration (breathing out) is important in respiration. To promote expiration, the diaphragm DP is required to be likely to move toward the head side X1 to contract the rib cage RC illustrated in FIG. 6. The diaphragm DP is a muscle membrane that closes a lower end of the rib cage RC. The diaphragm DP has a dome shape protruding toward the head side X1. The diaphragm DP has the dome shape during relaxation (during expiration), and becomes flat while a central part moves toward the leg side X2 during tension (during inspiration). The diaphragm DP is connected to a section near the second lumbar vertebra L2 continuous with the sacrum S, specifically, the lumbar vertebrae L1 to L3.

When the sacrum S illustrated in FIGS. 5, 6, 9, and 10 performs a nodding motion in which the sacrum S tilts forward of the person 50 (the same direction as that toward the upper side Z1 in FIG. 5), the lumbar vertebrae L1 to L5 connected to the sacrum S move forward, and the diaphragm DP in a dome shape connected to the lumbar vertebrae L1 to L3 is likely to be relaxed accordingly. Accordingly, the diaphragm DP is likely to move toward the head side X1 to promote expiration.

However, the sacroiliac joint J1 connecting the sacrum S and the pair of ilia LM is covered with many strong ligaments, so that only the sacrum S cannot be moved alone. Thus, the present inventor has considered to promote the nodding motion of the sacrum S by interlocking movement of the pair of ilia LM and the sacrum S.

As illustrated in FIG. 9, when the nodding motion of the sacrum S is performed, a force is applied to the ilium LM of each of the pair of hipbones HB forward the body (the same direction as that toward the upper side Z1 in FIG. 5) by the outer part LMb in the width direction Y of the iliac crest LMa that is an end section on the head side X1 of the ilium LM. Accordingly, the pair of ilia LM moves in a direction in which the pair of ilia LM closes inward (toward the center of the body). At this time, a gap or play is generated in the sacroiliac joint J1 to facilitate movement of the sacrum S. Accordingly, a promontory Sa being an end part on the head side X1 of the sacrum S moves forward (the same direction as that toward the upper side Z1 in FIG. 5), and a section on the leg side X2 of the sacrum S moves backward (the same direction as that toward the lower side Z2 in FIG. 5). Thus, the entire sacrum S can smoothly perform a nodding motion forward (direction Z1). When the nodding motion of the sacrum S increases, the diaphragm DP connected to a section near the second lumbar vertebra L2 (region of L1 to L3) relaxes to be likely to move toward the head side X1, and thus expiration is sufficiently performed. Then, contraction of the lower rib cage RC for the expiration is sufficiently performed accordingly.

The mat 1 of the present embodiment eliminates inhibition of the nodding motion of the sacrum S due to compression on the sacrum S with the mat 1 in the supine position, thereby enabling a movable region of the sacrum S to be expanded.

As illustrated in FIG. 9, when the sacrum S performs a nodding motion, the ilium LM of the hipbone HB moves inward in the width direction Y. Thus, an interval between the pair of ilia LM is narrowed, and pressure in the abdominal cavity is increased, so that the diaphragm DP is more likely to move toward the head side X1. In a section other than the ilium LM of the hipbone HB, the pubis PB and the ischium SN move outward in the width direction Y. (That is, a pubic symphysis PBa in FIG. 10 moves in a direction in which the pubic symphysis PBa opens.)

Then, after the sacrum S nods to perform expiration for a while, a rising motion of the sacrum S occurs as a reaction and a motion opposite to the nodding motion. The rising motion of the sacrum S is performed to move the promontory Sa on the head side X1 of the sacrum S backward (the same direction as that toward the lower side Z2 in FIG. 5), and a section on the leg side X2 of the sacrum S forward (the same direction as that toward the upper side Z1 in FIG. 5). When the sacrum S rises, the diaphragm DP connected to near the second lumbar vertebra L2 (L1 to L3) moves toward the leg side X2 to expand the rib cage RC, so that a large amount of inspiration can be achieved.

Features of the Present Embodiment (1)

The present inventor has extensively conducted studies on removing pressure that inhibits movement of the serratus posterior inferior muscle 41 that lowers the ribs during expiration and simultaneously achieving supple movement of the spine to promote respiration in the supine position, and thus having resulted in inventing the mat 1 below.

Specifically, the mat 1 of the present embodiment includes the back support part 3 that supports the back 52 of the person 50 in the supine position. The back support part 3 includes: a spine support part 8 that continuously supports a portion conforming to a section defined by three or more continuous lumbar vertebrae and thoracic vertebrae and including at least a first lumbar vertebra L1 to a twelfth thoracic vertebra T12 of the spine in the back 52 of the person 50 in the supine position; and the pair of serratus posterior inferior muscle corresponding parts 9 each of which is disposed on corresponding one of both sides of the spine support part 8 in the width direction Y and disposed below a portion conforming to one of a pair of left and right serratus posterior inferior muscles 41 of the person 50 in the supine position. The pair of serratus posterior inferior muscle corresponding parts 9 and the spine support part 8 are configured such that body pressure from the serratus posterior inferior muscle corresponding parts 9 is lower than body pressure from the spine support part 8.

According to such a configuration, the pair of serratus posterior inferior muscle corresponding parts 9 is provided below respective portions conforming to the pair of serratus posterior inferior muscles 41 of the person 50 in the supine position, and the spine support part 8 and the pair of serratus posterior inferior muscle corresponding parts 9 are configured such that the body pressure from the pair of serratus posterior inferior muscle corresponding parts 9 is lower than the body pressure from the spine support part 8. Accordingly, while the spine support part 8 supports the portion conforming to the section defined by three or more continuous lumbar vertebrae and thoracic vertebrae of a spine in the back of the person in the supine position, the section including at least the first lumbar vertebra L1 and the twelfth thoracic vertebra T12, the body pressure from the serratus posterior inferior muscle corresponding part 9 is reduced to lower than the body pressure from the spine support part 8, whereby compression on the serratus posterior inferior muscle 41 can be avoided. This configuration enables smoothly pulling down the group of the ribs constituting the rib cage during expiration while preventing the serratus posterior inferior muscle 41 from being disturbed by a repulsive force of the mat 1, and thus enables expiration to be easily performed.

Additionally, the spine support part 8 continuously supporting the portion conforming to the section defined by three or more continuous lumbar vertebrae and thoracic vertebrae and including the first lumbar vertebra L1 and the twelfth thoracic vertebra T12 enables the entire spine continuous from the lumbar vertebrae to the thoracic vertebrae during respiration to flexibly move, and thus preventing movement of the ribs connected to the thoracic vertebrae from stopping during respiration. Specifically, the spine support part 8 continuously supporting the portion conforming to the section defined by three or more continuous lumbar vertebrae and thoracic vertebrae and including the first lumbar vertebra L1 and the twelfth thoracic vertebra T12, and thus an obstacle to undulation of the spine such as to flexibly undulate in the vertical direction during respiration is eliminated as compared with when only a section of the lumbar vertebrae or the thoracic vertebrae is supported at a pinpoint. Accordingly, flexible movement of the entire spine continuing from the lumbar vertebrae to the thoracic vertebrae during respiration can be achieved.

Thus, the mat 1 having the above configuration enables simultaneously achieving avoidance of the compression on the serratus posterior inferior muscle 41 and the flexible movement of the spine, and thus enables promoting the respiration of the person 50 in the supine position.

(2)

The mat 1 of the present embodiment is configured such that each of the serratus posterior inferior muscle corresponding parts 9 is formed in a region including at least a locality (a locality intermediate in width of the portion in FIG. 8) of a portion conforming to a section where each of the pair of serratus posterior inferior muscles 41 joins the second lumbar vertebra L2.

The serratus posterior inferior muscle 41 includes the section where serratus posterior inferior muscle 41 joins the second lumbar vertebra L2, the section most particularly contributing to pulling down of the group of ribs during expiration. Thus, the serratus posterior inferior muscle corresponding part 9 which is formed in a region on the lower side Z2 of the portion conforming to the section where the serratus posterior inferior muscle 41 joins the second lumbar vertebra L2 enables reliably avoiding the compression on the section in the serratus posterior inferior muscle 41, the section most contributing to pulling down of the group of ribs, and then enables reliably promoting respiration.

(3)

The mat 1 of the present embodiment is configured such that each of the pair of serratus posterior inferior muscle corresponding parts 9 is formed in a region having ½ or more (preferably ¾ or more) of a projected area of each of the pair of serratus posterior inferior muscles 41 over the upper surface of the mat 1, the projected area including a portion conforming to a section where each of the serratus posterior inferior muscles 41 joins the second lumbar vertebra L2.

The region which has ½ or more of the projected area of the serratus posterior inferior muscle 41 over the upper surface of the mat 1, the projected area including the portion conforming to the section where the serratus posterior inferior muscles 41 join the second lumbar vertebra L2 and greatly contributes to pulling down the group of ribs during expiration. Thus, this configuration enables reliably avoiding compression on the section of the serratus posterior inferior muscle 41, the section greatly contributing to pulling down of the group of ribs, using the serratus posterior inferior muscle corresponding part 9 formed in the region of ½ or more of the projected area of the serratus posterior inferior muscle 41 over the upper surface of the mat 1, and then enables more reliably promoting respiration.

(4)

The mat 1 of the present embodiment is configured so as to set a width W1 of the spine support part 8 within a region of a width of a portion conforming to a section defined by three or more continuous lumbar vertebrae and/or thoracic vertebrae and including at least the first lumbar vertebra L1 and the twelfth thoracic vertebra T12.

This configuration enables the spine support part 8 to support the portion conforming to the section defined by three or more continuous lumbar vertebrae and/or thoracic vertebrae and including at least the first lumbar vertebra L1 and the twelfth thoracic vertebra T12 by setting the width W1 of the spine support part 8 to satisfy the above condition. Accordingly, the spine support part 8 does not inhibit movement of the ribs during respiration, so that the respiration can be reliably promoted.

(5)

The mat 1 of the present embodiment is configured such that the width W1 of the spine support part 8 is preferably set in a range of 4 cm to 11 cm.

This configuration enables the spine support part 8 to reliably promote respiration of a standard adult 50 without compressing the ribs by setting the width of the spine support part 8 to satisfy the above condition.

(6)

The mat 1 of the present embodiment is configured such that the serratus posterior inferior muscle corresponding part 9 is defined by a recess formed in a surface of the back support part 3.

This configuration enables body pressure from the serratus posterior inferior muscle corresponding part 9 to be reliably reduced to lower than body pressure from the spine support part 8 by allowing the spine support part 8 to support the portion conforming to the lumbar vertebrae and the thoracic vertebrae, and disposing a portion conforming to the serratus posterior inferior muscle 41 in the recess constituting the serratus posterior inferior muscle corresponding part 9. Accordingly, compression on the serratus posterior inferior muscle 41 can be reliably avoided.

(7)

The mat 1 of the present embodiment further includes a sacrum support part 12*a* that is disposed on a leg side X2 of the person 50 in the supine position from the spine support part 8 and supports a portion conforming to a sacrum S of the person 50 in the supine position. A height H2 of the sacrum support part 12*a* is set to be relatively lower than a height H3 of the spine support part 8.

This configuration further includes the sacrum support part 12*a* that supports the portion conforming to the sacrum S of the person 50 in the supine position, and the height H2 of the sacrum support part 12*a* is set to be relatively lower than the height 113 of the spine support part 8. Accordingly, the sacrum S can be turned toward the front side Z1 and the leg side X2 during expiration, or a nodding motion can be performed, without being inhibited by reaction force (body pressure) from the sacrum support part 12*a*. This configuration also enables smoothly performing the nodding motion of the sacrum S while flexibly moving the entire spine continuous from the lumbar vertebrae to the thoracic vertebrae by allowing the spine support part 8 to continuously support the portion conforming to the section defined by three or more continuous lumbar vertebrae and/or thoracic vertebrae and including the first lumbar vertebra L1 and the twelfth thoracic vertebra T12 as described above. When the sacrum S performs the nodding motion, the diaphragm DP connected to the lumbar vertebra continuous to the sacrum S moves in a direction X1 toward a head 51 of the person 50 in the supine position, and thus further facilitating expiration. Accordingly, respiration in the supine position can be further promoted.

(8)

The present inventor has extensively conducted studies focusing on movement of the pelvis PV to promote respiration in a supine position as described above, thereby resulting in finding out that promoting a nodding motion in which the sacrum S located between the pair of ilia LM in the pelvis PV tilts forward (in the same direction as that toward the upper side Z1 in FIG. 5) leads to promotion of respiration, and thus the invention of the mat 1 having the above configuration has been made.

The mat 1 of the present embodiment includes the ilium support 11 described above, and the sacrum support part 12*a* is set to be lower than the ilium support 11 in height in the vertical direction Z. This configuration reduces body pressure from the sacrum support part 12*a* to lower than body pressure from the ilium support 11, so that the nodding motion of the sacrum S can be smoothly performed.

Additionally, as the body pressure from the sacrum support part 12*a* decreases, the body pressure of the ilium support 11 relatively increases. Accordingly, while an outer part LMb of an iliac crest LMa in the pair of ilia LM is pressed in a closing direction (direction toward the center of the body in the width direction Y), a sacroiliac joint J1 is opened, and thus promoting the nodding motion of the sacrum S. Thus, the nodding motion of the sacrum S is smoothly performed even in the supine position, and thus enabling deep respiration even during sleep to improve sleeping comfort.

Specifically, the mat 1 of the present embodiment further includes a pair of ilium support parts 11 that is disposed on both sides in the width direction Y of the sacrum support part 12*a* to individually support a portion conforming to at least an outer part in the width direction Y of the iliac crest LMa in the pair of ilia LM of the person 50 in the supine position from below.

The height H2 of the sacrum support part 12*a* is set to be relatively lower than a height H1 of the ilium support 11.

This configuration further includes the pair of ilium support parts 11 that individually supports the portion conforming to at least the outer part in the width direction Y of the iliac crest LMa in corresponding one of the pair of ilia LM of the person 50 in the supine position from below, so that the nodding motion of the sacrum S can be more easily performed by promoting medial rotation of the ilium LM. That is, turning (medial rotation) movement of the pair of ilia LM toward the front side Z1 and the center of the body is promoted by allowing a portion conforming to the iliac crest LMa to receive reaction force (body pressure) from the ilium support 11. This medial rotation of the pair of ilia LM loosens the sacroiliac joint J1 between the ilium LM and the sacrum S, so that the nodding motion of the sacrum S can be more easily performed. Additionally, the height H2 of the sacrum support part 12*a* is set to be relatively lower than the height H1 of the ilium support 11, so that the body pressure from the sacrum support part 12*a* is reduced to lower than the body pressure from the ilium support 11, and thus the nodding motion of the sacrum S is not inhibited. Accordingly, respiration in the supine position can be further promoted.

(9)

The ilium support 11 in the present embodiment is higher than the spine support part 8, so that effect of allowing the ilium LM to perform the medial rotation using the ilium support 11 can be enhanced.

The height H1 of the ilium support 11 may be set to be equal to the height 113 of the spine support part 8. In this case, the back 52 of the person 50 in the supine position and the portion conforming to the ilium LM are supported on the same plane on the mat 1, and thus enabling reduction in uncomfortable feeling caused by the ilium support 11 protruding upward.

(10)

The mat 1 of the present embodiment is configured such that the back support part 3 further includes a pair of outer support parts 10 that is positioned outside the corresponding pair of serratus posterior inferior muscle corresponding parts 9 in the width direction Y to support at least an outer part of the back 52, the outer part being outside the serratus posterior inferior muscle 41 in the width direction Y.

This configuration allows the pair of outer supports to be positioned widthwise outside of the pair of serratus posterior inferior muscle corresponding parts 9, thereby supporting at least the outer part of the back 52, the outer section being outside the serratus posterior inferior muscle 41 in the width direction Y (a section outside the serratus posterior inferior muscle 41 in the width direction Y, and a section of the serratus posterior inferior muscle 41, the section being connected to each of the ninth to twelfth ribs R9 to R12 in FIG. 8). Thus, even when the serratus posterior inferior muscle corresponding part 9 avoids compression on the portion conforming to the serratus posterior inferior muscle 41, the back 52 can be stably supported by the spine support part 8 and the pair of outer support parts 10. Although the mat 1 illustrated in FIG. 1 includes a section 31 on the head side X1 from the spine support part 8, the serratus posterior inferior muscle corresponding part 9, and the outer support 10 in the back support part 3, the section 31 constituting the same plane at the same height as the spine support part 8 and the outer support 10, structure of the section 31 on the head side X1 in the back support part 3 is not particularly limited in the present invention, and various structures are available.

Modification (A)

Although the above embodiment shows an example in which the mat 1 is integrally made of a material such as urethane, and the serratus posterior inferior muscle corresponding part 9 is formed of the recess, the present invention is not limited thereto. A modification of the present invention may be configured such that the serratus posterior inferior muscle corresponding part 9 includes a serratus posterior inferior muscle support part instead of the recess, the serratus posterior inferior muscle support part being configured to support a portion conforming to the serratus posterior inferior muscle 41 of the person 50 in the supine position, and having a height set to be the same as the height of the spine support part 8, and the serratus posterior inferior muscle support part is set to be lower in hardness than the spine support part 8 by changing properties of a material of at least one of the spine support part 8 and the serratus posterior inferior muscle support part.

This configuration enables reducing body pressure from the serratus posterior inferior muscle support part while supporting the lumbar vertebrae and the thoracic vertebrae with the spine support part 8 because the serratus posterior inferior muscle support part is softer than the spine support part 8. Accordingly, compression on the serratus posterior inferior muscle 41 can be avoided.

(B)

Although the mat 1 of the above embodiment includes the pair of serratus posterior inferior muscle corresponding parts 9 configured by the recess illustrated in FIG. 1 to avoid the compression on the pair of serratus posterior inferior muscles 41 illustrated in FIG. 8, thereby promoting expiration of a person in a supine position, another configuration acquired by improving this configuration is conceivable in which the mat is capable of avoiding compression on not only the serratus posterior inferior muscle 41 but also another accessory respiratory muscle to promote expiration.

Figure 12:
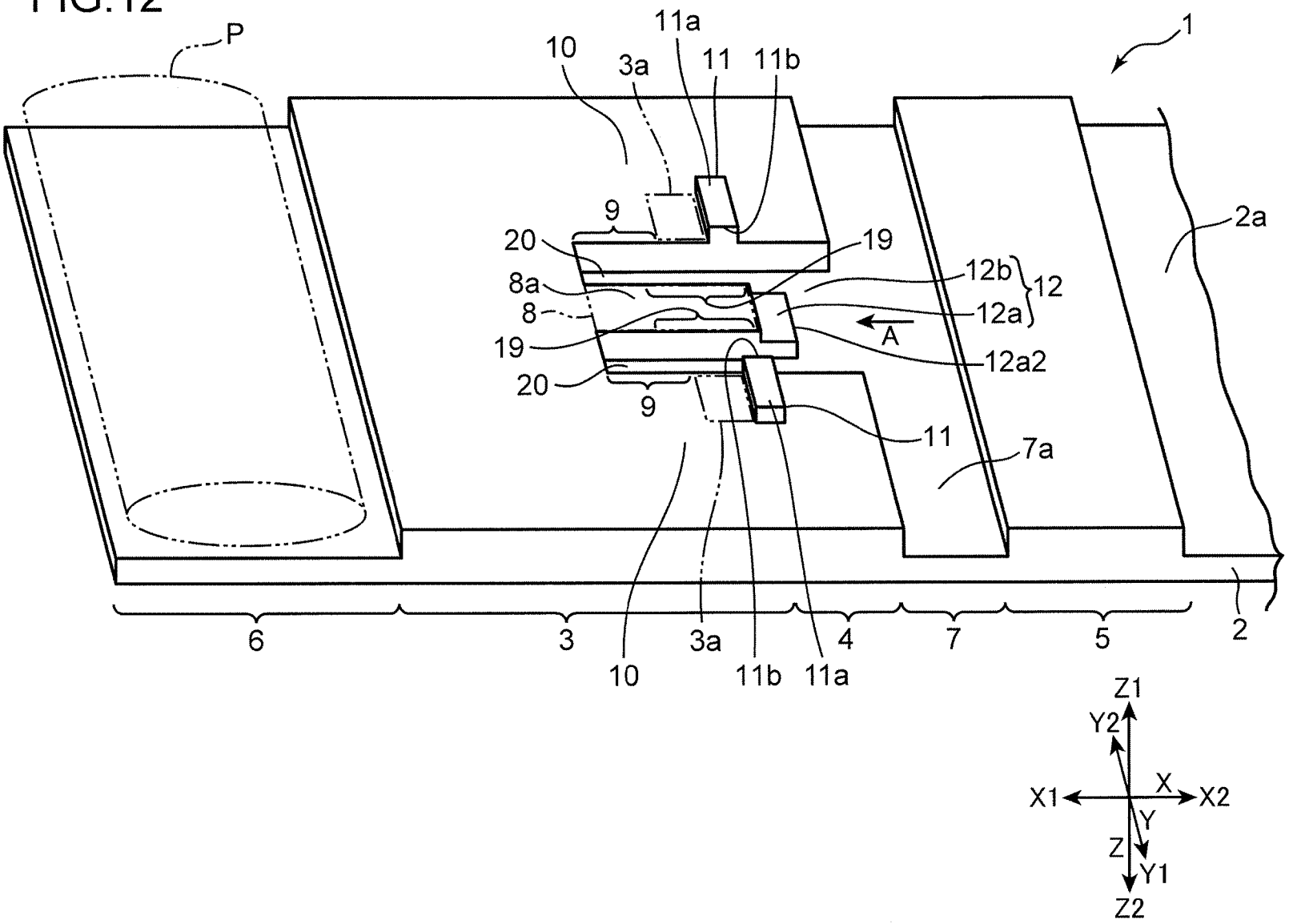
FIG. 12 is a perspective view illustrating an overall configuration of a mat in which a quadratus lumborum muscle corresponding part that partially overlaps the serratus posterior inferior muscle corresponding part is added as a modification of the present invention.
Figure 13:
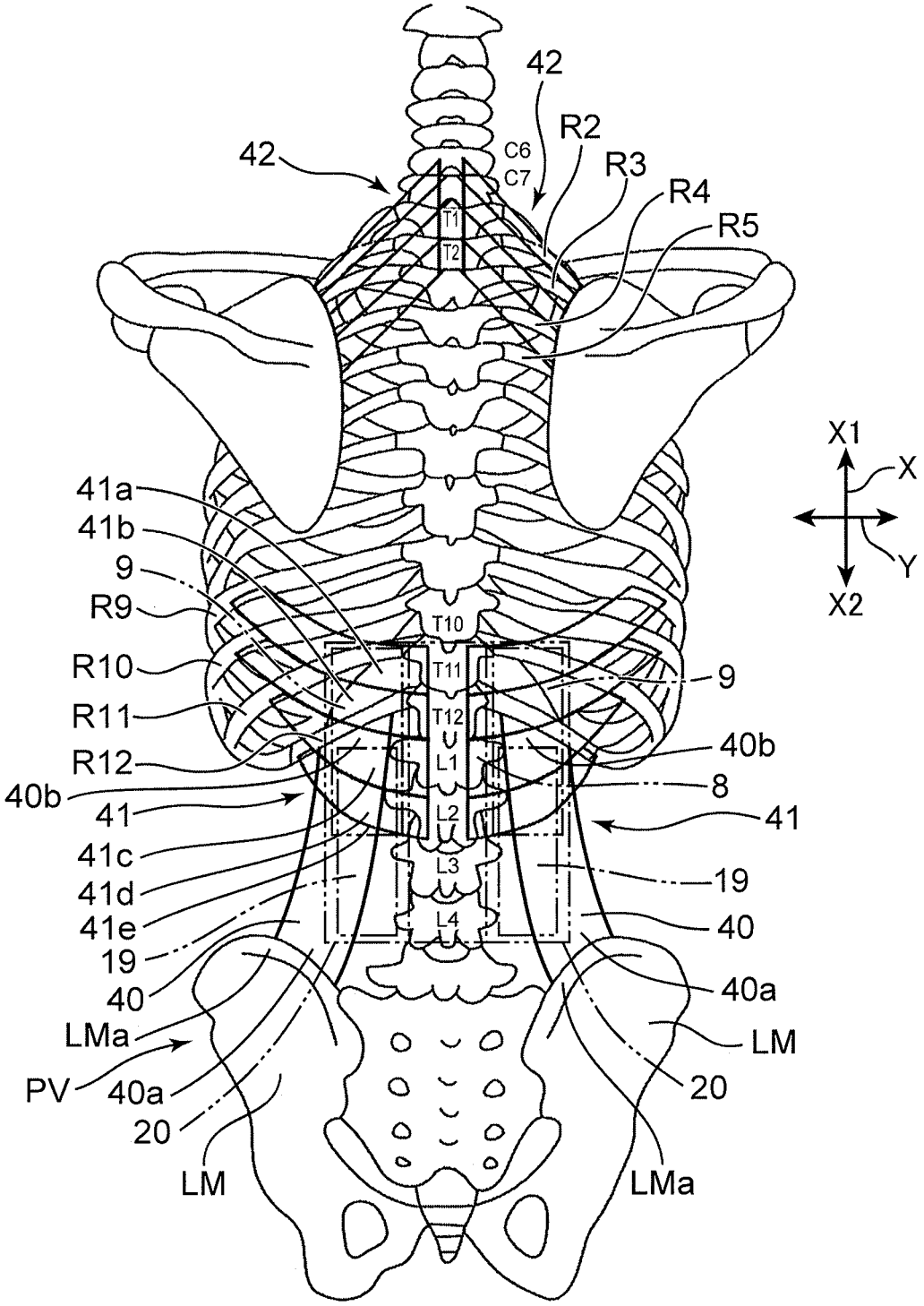
FIG. 13 is an explanatory diagram schematically illustrating placement of serratus posterior inferior muscle and quadratus lumborum muscle of a person, and the serratus posterior inferior muscle corresponding part and the quadratus lumborum muscle corresponding part of the mat of FIG. 12.

Then, the mat 1 illustrated in FIGS. 12 and 13 as a modification of the present invention includes a serratus posterior inferior muscle corresponding part 9 and a quadratus lumborum muscle corresponding part 19 that are configured by a common recess 20 to avoid compression on not only the serratus posterior inferior muscle 41 but also a quadratus lumborum muscle 40 that is one of accessory respiratory muscles.

Here, the quadratus lumborum muscle 40 is a flat muscle in a substantially band shape extending from the ilium LM of the pelvis PV toward the head side X1 to be connected to the twelfth rib R12 on both sides of the spine as illustrated in FIG. 13. That is, the quadratus lumborum muscle 40 includes an origin 40*a* that is connected to the iliac crest LMa of the ilium LM, and an insertion 40*b* on the head side X1 that is connected to the twelfth rib R12. The quadratus lumborum muscle 40 also includes an insertion (not illustrated) close to the spine, the insertion being connected to a transverse process of each of the first lumbar vertebra L1 to the fourth lumbar vertebra L4.

The quadratus lumborum muscle 40 has main functions below. First, when the quadratus lumborum muscles 40 on both sides of the spine contract simultaneously in a standing state of a person, an upper body of the person can be bent backward (backbend). Then, when only the quadratus lumborum muscle 40 on one side of both sides of the spine contracts, the upper body can be laterally bent. Additionally, when a person is in the supine position, the quadratus lumborum muscle 40 stabilizes the pair of ilia LM while applying a force in a direction of attracting the pair of ilia toward the front side Z1 during expiration. Accordingly, a nodding motion of the sacrum S (see FIG. 9) is promoted, and the group of ribs can be pulled down along with the nodding motion. The promotion of the nodding motion of the sacrum S using the quadratus lumborum muscle 40 will be described in detail later.

Specifically, the mat 1 illustrated in FIGS. 12 and 13 is configured as follows.

The spine support part 8 continuously supports a portion of the spine, the portion conforming to at least a portion from the twelfth thoracic vertebra T12 to the third lumbar vertebra L3 (a section from the eleventh thoracic vertebra T11 to the fourth lumbar vertebra L4 in FIG. 13).

The back support part 3 further includes a pair of quadratus lumborum muscle corresponding parts 19 in addition to the serratus posterior inferior muscle corresponding part 9 described above. The pair of quadratus lumborum muscle corresponding parts 19 is disposed on widthwise both sides of the spine support part 8, and is disposed below a portion conforming to corresponding one of the pair of left and right quadratus lumborum muscles 40 of a person in a supine position.

The quadratus lumborum muscle corresponding part 19 in the present embodiment is configured by a section on the leg side X2 in the recess 20 formed by being recessed in a thickness direction (vertical direction Z) of the mat 1. The recess 20 includes inner surfaces (specifically, a bottom surface and an inner peripheral surface of the recess 20) that form a space reducing compression on a portion conforming to the serratus posterior inferior muscle 41 and the quadratus lumborum muscle 40 in the back.

That is, a section on the head side X1 of the recess 20 constitutes the serratus posterior inferior muscle corresponding part 9, and a section on the leg side X2 of the recess 20 constitutes the quadratus lumborum muscle corresponding part 19. As illustrated in FIG. 13, the serratus posterior inferior muscle corresponding part 9 and the quadratus lumborum muscle corresponding part 19 overlap each other, or continue, in portions conforming to both left and right sides of the first lumbar vertebra L1 and the second lumbar vertebra L2. The serratus posterior inferior muscle corresponding part 9 and the quadratus lumborum muscle corresponding part 19 are formed in one recess 20 and are equal in depth.

The quadratus lumborum muscle corresponding part 19 may be set in a region including at least a locality of a portion in which the quadratus lumborum muscle 40 is projected on the upper surface of the mat 1, and is preferably set in a region between the origin 40*a* and the insertion 40*b* of the quadratus lumborum muscle 40 and excluding the origin 40*a* and the insertion 40*b* to effectively avoid compression on the quadratus lumborum muscle 40.

As with the mat 1 illustrated in FIGS. 1 and 2, the mat 1 includes a pair of ilium support parts 11 each of which individually supports a portion conforming to at least the outer part LMb (see FIGS. 9 and 10) in the width direction Y of the iliac crest LMa of corresponding one of the pair of ilia LM in the pelvis PV of a person in a supine position, the portion being supported from below the iliac crest LMa on the lower side Z2. The placement surface 11*a* constituting the upper surface of the ilium support 11 is disposed at a position higher than the upper surface of a peripheral part (specifically, a section 3*a* of the back support part 3 located on the head side X1 with respect to the ilium support 11) of the ilium support 11 in the back support part 3.

The pair of quadratus lumborum muscle corresponding parts 19 and the spine support part 8 are configured such that body pressure from the quadratus lumborum muscle corresponding parts 19 is lower than body pressure from the spine support part 8. Specifically, the quadratus lumborum muscle corresponding part 19 is configured by a section on the leg side X2 in the recess 20 as illustrated in FIG. 12 to reduce the body pressure from the quadratus lumborum muscle corresponding part 19 to lower than the body pressure from the spine support part 8. This configuration also reduces the body pressure from the quadratus lumborum muscle corresponding part 19 to lower than body pressure from the outer support 10 equal in height to the spine support part 8.

Other configurations of mat 1 illustrated in FIG. 12 are common to the configuration of mat 1 (see FIGS. 1 to 11) of the embodiment described above, and thus will not be described.

According to the configuration of the mat 1 illustrated in FIGS. 12 and 13, the pair of quadratus lumborum muscle corresponding parts 19 is provided below respective portions conforming to the pair of quadratus lumborum muscles 40 of a person in a supine position, and the spine support part 8 and the pair of quadratus lumborum muscle corresponding parts 19 are configured such that the body pressure from the pair of quadratus lumborum muscle corresponding parts 19 is lower than the body pressure from the spine support part 8. Accordingly, while the spine support part 8 continuously supports a portion conforming to a section including at least the twelfth thoracic vertebra T12 to the third lumbar vertebra L3 of the spine, the body pressure from the quadratus lumborum muscle corresponding part 19 can be reduced to lower than the body pressure from the spine support part 8. This configuration enables preventing the quadratus lumborum muscle corresponding part 19 from compressing the quadratus lumborum muscle 40.

The mat also includes the pair of ilium support parts 11 each of which individually supports the portion conforming to at least the outer part LMb (see FIG. 10) in the width direction Y of the iliac crest LMa of the corresponding one of the pair of ilia LM in the pelvis PV of a person in a supine position, the portion being supported from below on the lower side Z2 of the iliac crest LMa, and the placement surface 11*a* (upper surface) of each of the ilium support parts 11 is disposed at a position higher than an upper surface of a peripheral part (specifically, the section 3*a* of the back support part 3 located on the head side X1 with respect to the ilium support 11) of the ilium support 11 in the back support part 3. The quadratus lumborum muscle 40 is connected at one end to the iliac crest LMa, and thus the ilium support 11 supports the one end of the quadratus lumborum muscle 40 at a position outside the quadratus lumborum muscle 40 in a body side direction and higher than the quadratus lumborum muscle corresponding part 19. Thus, the pair of ilium support parts 11 each can support a portion conforming to at least the widthwise outer section LMb of the iliac crest LMa in the ilium LM at a position higher than the peripheral part of the ilium support 11, so that the quadratus lumborum muscle 40 can be prevented from being compressed also by the ilium support 11.

Then, the quadratus lumborum muscle 40 can be prevented from being compressed by both the quadratus lumborum muscle corresponding part 19 and the ilium support 11 as described above, so that the quadratus lumborum muscle 40 of a person in a supine position can be stabilized while a force in a direction of attracting the pair of ilia LM (see FIGS. 9 and 10) connected to respective one ends of the pair of quadratus lumborum muscles 40 toward the front side Z1 of the person in the supine position during expiration without being disturbed by a repulsive force of the mat. Accordingly, the sacrum S located between the pair of ilia LM in the pelvis PV can easily perform a so-called nodding motion in which the sacrum S inclines toward the front side Z1 of the person in the supine position. Then, the diaphragm DP (see FIG. 6) connected to the lumbar vertebrae and the thoracic vertebrae is likely to be relaxed along with the nodding motion of the sacrum S. At the same time, the group of ribs can be lowered by the pair of quadratus lumborum muscles 40. Accordingly, expiration in the supine position can be further promoted.

This configuration thus enables expiration to be more easily performed by effect of promoting expiration due to relaxation of compression on not only the serratus posterior inferior muscle 41 using the serratus posterior inferior muscle corresponding part 9 but also the quadratus lumborum muscle 40 using the quadratus lumborum muscle corresponding part 19 as illustrated in FIG. 13.

Each of the pair of quadratus lumborum muscle corresponding parts 19 illustrated in FIGS. 12 and 13 is preferably formed in a region between the origin 40*a* connected to ilium LM and the insertion 40*b* connected to the twelfth rib R12 in each of the pair of quadratus lumborum muscles 40, the region including a portion conforming to a section other than the origin 40*a* and the insertion 40*b*. The quadratus lumborum muscle 40 includes a section between the origin 40*a* connected to the ilium LM and the insertion 40*b* connected to the twelfth rib R12, and it is considerable that the section, particularly, an intermediate part between the origin 40*a* and the insertion 40*b*, exclusively contributes to the stabilization of the ilium LM. Thus, this configuration enables the ilium LM to be effectively stabilized while applying a force in a direction of attracting the ilium LM toward the front side Z1 by allowing the quadratus lumborum muscle corresponding part 19 to effectively reduce body pressure of the section other than the origin 40*a* connected to the ilium LM and the insertion 40*b* connected to the twelfth rib R12 in the quadratus lumborum muscle 40, thereby avoiding compression on the quadratus lumborum muscle 40, while a state in which the ilium LM is supported by the ilium support 11 is maintained. Accordingly, the nodding motion of the sacrum S and the relaxation of the diaphragm DP can be further promoted. At the same time, the group of ribs can be effectively lowered by the pair of quadratus lumborum muscles 40. Accordingly, expiration is further facilitated.

Then, the quadratus lumborum muscle corresponding part 19 illustrated in FIGS. 12 and 13 is formed overlapping the serratus posterior inferior muscle corresponding part 9 at a portion conforming to each of both left and right sides of the first lumbar vertebra L1 and the second lumbar vertebra L2.

As illustrated in FIG. 13, both the serratus posterior inferior muscle 41 and the quadratus lumborum muscle 40 are connected to transverse processes of the first and second lumbar vertebrae L1 and L2 and overlap each other near the first and second lumbar vertebrae L1 and L2. Then, the quadratus lumborum muscle corresponding part 19 is formed overlapping the serratus posterior inferior muscle corresponding part 9 at the portion conforming to each of both left and right sides of the first lumbar vertebra L1 and the second lumbar vertebra L2 as described above, so that compression on parts on the both left and right sides of the first and second lumbar vertebrae L1 and L2 in the serratus posterior inferior muscle 41 and the quadratus lumborum muscle 40 can be reliably avoided, and thus further facilitating expiration.

Although the serratus posterior inferior muscle corresponding part 9 and the quadratus lumborum muscle corresponding part 19 overlap each other in the modification illustrated in FIGS. 12 and 13, the parts may not overlap each other. For example, the serratus posterior inferior muscle corresponding part 9 may be formed for a portion conforming to a section from the eleventh thoracic vertebra T11 to the first lumbar vertebra L1 on each of both left and right sides, and the quadratus lumborum muscle corresponding part 19 may be formed for a portion conforming to a section from the third lumbar vertebra L3 to the fourth lumbar vertebra L4 on each of both left and right sides (i.e., the serratus posterior inferior muscle corresponding part 9 and the quadratus lumborum muscle corresponding part 19 may be each configured by individual recesses).

The mat 1 illustrated in FIG. 12 includes the quadratus lumborum muscle corresponding part 19 that is configured by the recess 20 (specifically, a section on the leg side X2 in the recess 20) formed by being recessed in the thickness direction (vertical direction Z) of the mat 1 in the back support part 3.

This configuration enables body pressure from the quadratus lumborum muscle corresponding part 19 to be reliably reduced to lower than body pressure from the spine support part 8 by allowing the spine support part 8 to support a portion conforming to the lumbar vertebrae, and also disposing a portion conforming to the quadratus lumborum muscle 40 in the recess 20 constituting the quadratus lumborum muscle corresponding part 19 (specifically, disposing the portion to be fitted into the recess 20). Accordingly, compression on the quadratus lumborum muscle 40 can be reliably avoided.

Although the mat 1 illustrated in FIG. 12 above includes the quadratus lumborum muscle corresponding part 19 that is configured by the section on the leg side X2 in the recess 20, the mat 1 alternatively may include a section corresponding to the quadratus lumborum muscle corresponding part 19, the section being reduced in hardness. That is, the quadratus lumborum muscle corresponding part 19 may include a quadratus lumborum muscle support part that supports a portion conforming to the quadratus lumborum muscle 40 of a person in a supine position, a height of the quadratus lumborum muscle support part is set to be the same as the height of the spine support part 8, and hardness of the quadratus lumborum muscle support part is set to be lower than the hardness of the spine support part 8. This configuration enables reducing body pressure from the quadratus lumborum muscle support part while supporting the lumbar vertebrae with the spine support part 8 because the quadratus lumborum muscle support is softer than the spine support part 8. Accordingly, compression on the quadratus lumborum muscle 40 can be avoided.

(C)

Figure 14:
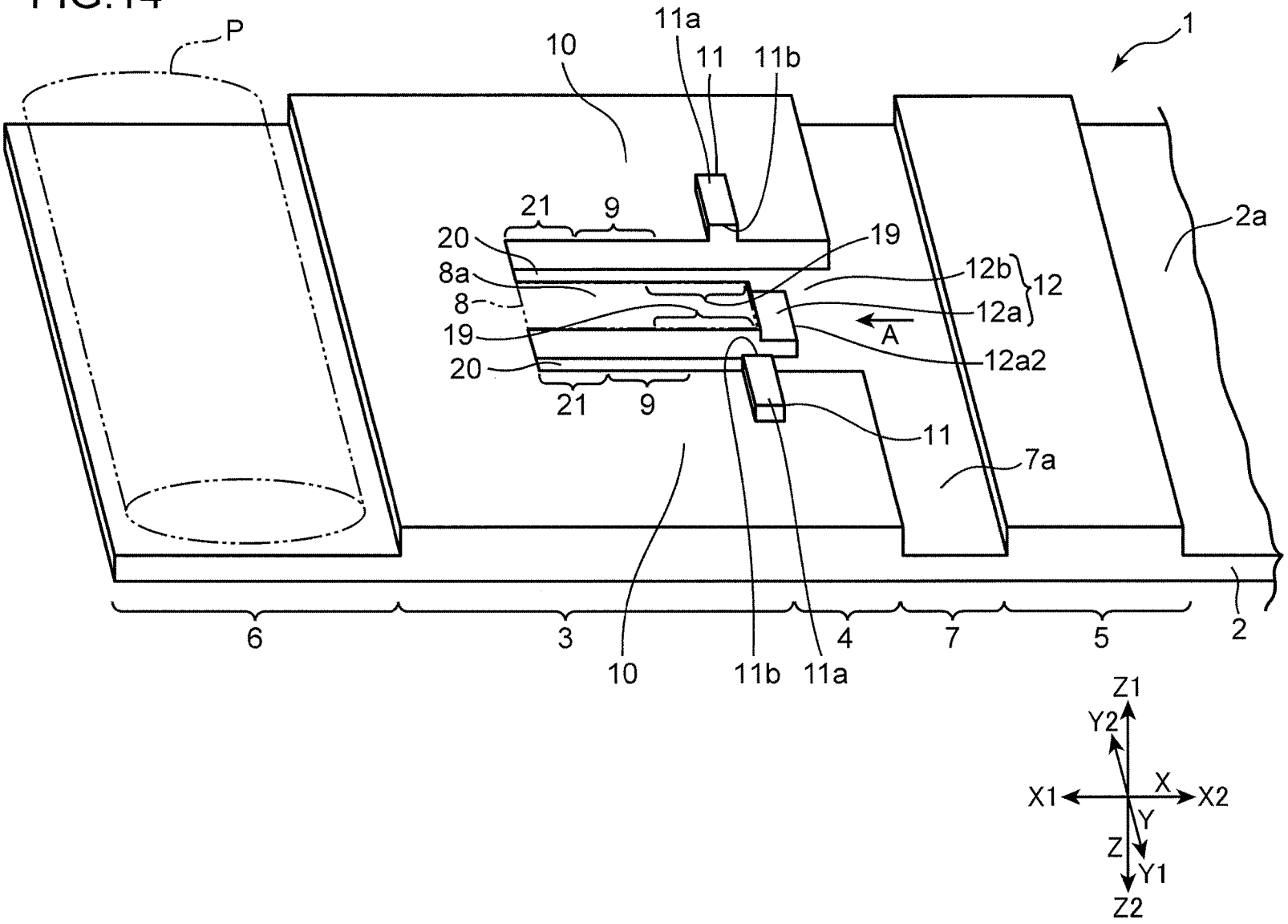
FIG. 14 is a perspective view illustrating a general configuration of a mat in which an intermediate rib corresponding part is further added to a section of the serratus posterior inferior muscle corresponding part in FIG. 12, the section being close to the head, as another modification of the present invention.
Figure 15:
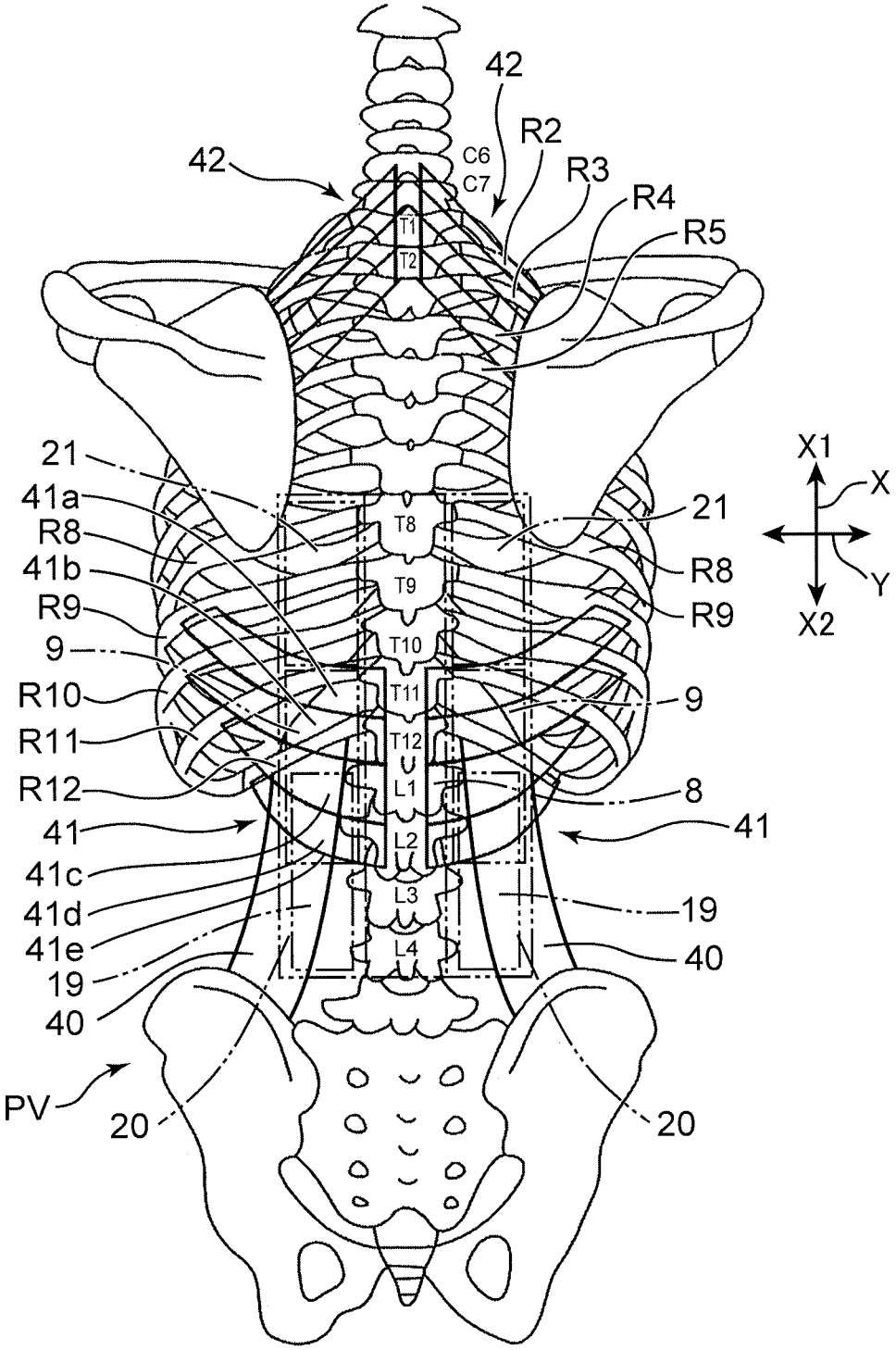
FIG. 15 is an explanatory diagram schematically illustrating placement of serratus posterior inferior muscle, quadratus lumborum muscle, and eighth to tenth ribs of a person, and the serratus posterior inferior muscle corresponding part, the quadratus lumborum muscle corresponding part, and the intermediate rib corresponding part of the mat of FIG. 14.

As still another modification of the mat of the present invention, the recess 20 of the mat 1 illustrated in FIG. 12 may be extended toward the head side X1 as illustrated in FIGS. 14 and 15 to avoid compression on the eighth rib R8 and the ninth rib R9.

That is, the recess 20 illustrated in FIGS. 14 and 15 further includes an intermediate rib corresponding part 21 corresponding to the eighth rib R8 and the ninth rib R9, and being disposed on the head side X1 with respect to the serratus posterior inferior muscle corresponding part 9. This configuration enables avoiding compression on the eighth rib R8 and the ninth rib R9 because body pressure from the intermediate rib corresponding part 21 is lower than body pressure from the spine support part 8. Accordingly, the compression on the eighth rib R8 and the ninth rib R9 of a person in a supine position is avoided causing smooth movement of the rib cage including the eighth rib R8 and the ninth rib R9 in the height direction during respiration, and thus smoother respiration is promoted.

(D)

Figure 16:
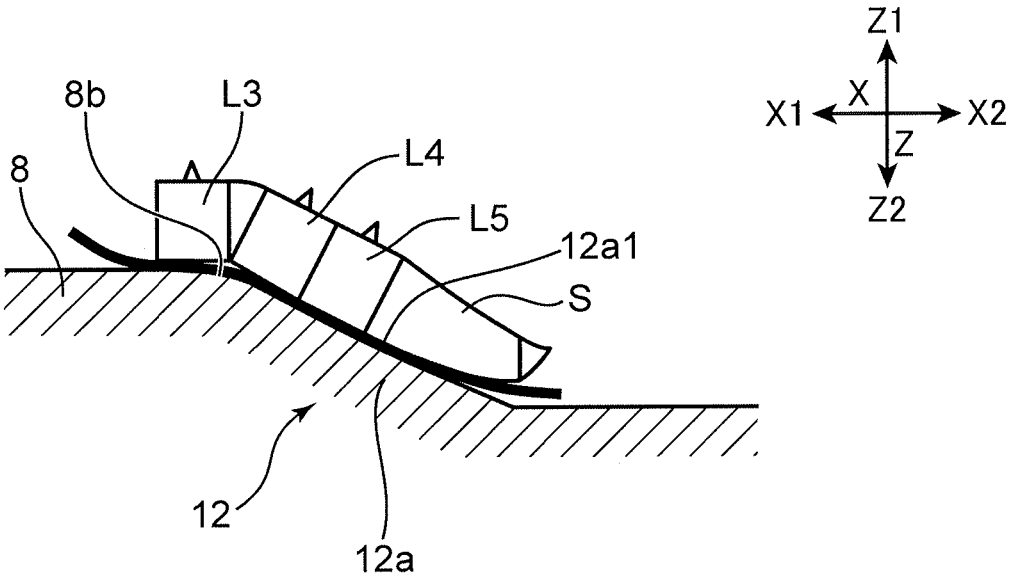
FIG. 16 is an explanatory sectional view illustrating a configuration in which a sacrum support part includes a placement surface lowering toward the leg and a portion conforming to the sacrum and the lumbar vertebrae is supported by the placement surface of the sacrum support part as still another modification of the present invention.

Although the placement surface 12*a*1 of the sacrum support part 12*a* is a flat surface in the horizontal direction in the above embodiment, the present invention is not limited thereto. As still another modification of the present invention, the sacrum support part 12*a* may have a height set to decrease toward the legs of person 50 in the supine position (i.e., toward the leg side X2), and the sacrum support part 12*a* may continuously support at least the sacrum S of person 50 in the supine position and a portion conforming to the lumbar vertebra adjacent to the sacrum S from below as illustrated in FIG. 16. That is, the placement surface 12*a*1 of the sacrum support part 12*a* may be formed in a slope shape descending toward the leg side X2, and a load applied to the lumbar vertebrae L3 to L5 connected to the sacrum S may be reduced due to the placement surface 12*a*1 in a slope shape.

This configuration includes the sacrum support part 12*a* with the placement surface 12*a*1 inclined downward toward the legs of person 50 in the supine position continuously on the upper surface 8*a* of the spine support part 8. Thus, this configuration enables the upper surface 8*a* of the spine support part 8 and the placement surface 12*a*1 of the sacrum support part 12*a* continuous to the upper surface 8*a* to continuously support at least a region from the twelfth thoracic vertebra T12 to the sacrum S including all the lumbar vertebrae even when the sacrum S nods toward the front side Z1, and thus enables supporting the region while dispersing body pressure using the surfaces in contact with a wide region of the portion conforming to the sacrum S and the lumbar vertebrae. Accordingly, a load to be applied to the lumbar vertebrae connected to the sacrum S can be further reduced.

That is, when the entire portion conforming to the lumbar vertebrae L4 and L5, and the sacrum S is placed on the placement surface 12*a*1 in a slope shape, the lumbar vertebrae L3 and L4 are bent at the leg side edge 8*b* of the spine support part 8 at a small angle as illustrated in FIG. 16. This reveals that the bending angle between the lumbar vertebrae L3 and L4 significantly decreases as compared with that of the sacrum S partially placed on the leg side edge 12*a*2 in a horizontal shape of the placement surface 12*a*1 as illustrated in FIG. 16, and thus loads to be applied to the lumbar vertebrae L3 to L5 decrease.

(E)

Although the sacrum corresponding part 12 including the sacrum support part 12*a* that supports a portion conforming to the sacrum S is shown in the above embodiment as an example of the sacrum corresponding part 12 disposed between the pair of ilium support parts 11 and positioned below the sacrum S, the present invention is not limited thereto. The sacrum corresponding part 12 of the present invention is only required to be disposed between the pair of ilium support parts 11 and positioned below the sacrum S, and to apply body pressure to a portion conforming to the sacrum S of the person in the supine position from the sacrum corresponding part, the body pressure being lower than body pressure applied to a portion conforming to the pair of ilia LM of person 50 in the supine position from the pair of ilium support parts 11.

Thus, the sacrum corresponding part 12 may be entirely formed of the sacrum non-support part 12*b* that does not support the portion conforming to the sacrum S by being separated from the portion conforming to the sacrum S of the person in the supine position, as still another modification of the present invention. This configuration allows the sacrum S to be accommodated in a space formed above the sacrum non-support part 12*b*. This configuration also enables the portion conforming to the sacrum S to be supported to be able to perform a nodding motion without being affected by reaction force (body pressure) from the sacrum non-support part 12*b* constituting the sacrum corresponding part 12 at all. Accordingly, loads to be applied to the lumbar vertebrae L3 to L5 connected to the sacrum S can be reduced.

(F)

Although the mat 1 of the above embodiment includes the back support part 3, the pelvis support 4 (the pair of ilium support parts 11 and the sacrum support part 12*a*), and the leg support 5, which are each in the shape of a flat rectangular thick plate as illustrated in FIGS. 1 to 7, the present invention is not limited thereto. Thus, the components each may be formed in a curved shape along the body shape of person 50 in the supine position. In particular, the section supporting the portion conforming to the sacroiliac joint J1 preferably has a shape having a smooth inclination or space that does not apply stress to the portion conforming to the sacroiliac joint J1.

Summary of Embodiment

The above embodiment is summarized as follows.

A mat according to the embodiment above includes a back support part that supports a back of a person in a supine position, in which the back support part includes: a spine support part that continuously supports a portion conforming to a section defined by three or more continuous lumbar vertebrae and thoracic vertebrae of a spine in the back of the person in the supine position, the section including at least a first lumbar vertebra to a twelfth thoracic vertebra; and a pair of serratus posterior inferior muscle corresponding parts which are respectively disposed on widthwise both sides of the spine support part and below a portion conforming to a pair of left and right serratus posterior inferior muscles of the person in the supine position, and the pair of serratus posterior inferior muscle corresponding parts and the spine support part are configured such that a body pressure from the pair of serratus posterior inferior muscle corresponding parts is lower than a body pressure from the spine support part.

According to the configuration, the pair of serratus posterior inferior muscle corresponding parts is provided below respective portions conforming to the pair of serratus posterior inferior muscles of the person in the supine position, and the spine support part and the pair of serratus posterior inferior muscle corresponding parts are configured such that the body pressure from the pair of serratus posterior inferior muscle corresponding parts is lower than the body pressure from the spine support part. Accordingly, while the spine support part supports the portion conforming to the section defined by three or more continuous lumbar vertebrae and thoracic vertebrae and including at least the first lumbar vertebra and the twelfth thoracic vertebra of the spine, the body pressure from the serratus posterior inferior muscle corresponding part is reduced to lower than the body pressure from the spine support part, whereby compression on the serratus posterior inferior muscle can be avoided. This configuration enables smoothly pulling down the group of the ribs constituting the rib cage during expiration while preventing the serratus posterior inferior muscle from being disturbed by a repulsive force of the mat, and thus enables expiration to be easily performed.

Additionally, the spine support part continuously supporting the portion conforming to the section defined by three or more continuous lumbar vertebrae and thoracic vertebrae and including the first lumbar vertebra and the twelfth thoracic vertebra enables the entire spine continuous from the lumbar vertebrae to the thoracic vertebrae during respiration to flexibly move, and thus preventing movement of the ribs connected to the thoracic vertebrae from stopping during respiration.

Thus, the mat having the above configuration enables simultaneously achieving avoidance of the compression of the serratus posterior inferior muscle and the flexible movement of the spine, and thus enables promoting the respiration of the person in the supine position.

The above mat may be preferably configured such that each of the serratus posterior inferior muscle corresponding parts is formed in a region including at least a locality of a portion conforming to a section where each of the pair of serratus posterior inferior muscles joins the second lumbar vertebra.

The serratus posterior inferior muscle includes a section joining the second lumbar vertebra, the section most particularly contributing to pulling down the group of ribs during expiration. Thus, the serratus posterior inferior muscle corresponding part which is formed in the region below the portion conforming to the section where the serratus posterior inferior muscle joins the second lumbar vertebra enables reliably avoiding the compression of the section in the serratus posterior inferior muscle, the section most contributing to pulling down the group of ribs, and then enables reliably promoting respiration.

The above mat may be preferably configured such that each of the pair of serratus posterior inferior muscle corresponding parts is formed in a region having ½ or more of a projected area of each of the pair of serratus posterior inferior muscles over on an upper surface of the mat, the projected area covering a portion conforming to a section where each of the pair of serratus posterior inferior muscles joins the second lumbar vertebra.

The serratus posterior inferior muscle includes the region having ½ or more of a projected area of the serratus posterior inferior muscle over the upper surface of the mat, the projected area covering the portion conforming to the section where the serratus posterior inferior muscle joins the second lumbar vertebra. The region greatly contributes to pulling down of the group of ribs during expiration. Thus, this configuration enables reliably avoiding compression on the section of the serratus posterior inferior muscle, which greatly contributes to pulling down of the group of ribs, using the serratus posterior inferior muscle corresponding part formed in the region having ½ or more of the projected area of the serratus posterior inferior muscle over the upper surface of the mat, and then enables more reliably promoting respiration.

The mat above may be preferably configured so as to set a width of the spine support part within a width of a portion conforming to a section defined by three or more continuous lumbar vertebrae and/or thoracic vertebrae and including at least the first lumbar vertebra and the twelfth thoracic vertebra.

This configuration enables the spine support part to support the portion conforming to the section defined by three or more continuous lumbar vertebrae and/or thoracic vertebrae and including at least the first lumbar vertebra and the twelfth thoracic vertebra by setting the width of the spine support part to satisfy the above condition. Accordingly, the spine support part does not inhibit movement of the ribs during respiration, so that the respiration can be reliably promoted.

The above mat may be preferably configured such that the serratus posterior inferior muscle corresponding part is defined by a recess formed in a surface of the back support part.

This configuration enables body pressure from the serratus posterior inferior muscle corresponding part to be reliably reduced to lower than body pressure from the spine support part by allowing the spine support part to support a portion conforming to the lumbar vertebrae and the thoracic vertebrae, and disposing a portion conforming to the serratus posterior inferior muscle in the recess constituting the serratus posterior inferior muscle corresponding part. Accordingly, compression on the serratus posterior inferior muscle can be reliably avoided.

The above mat may be preferably configured such that the serratus posterior inferior muscle corresponding part includes a serratus posterior inferior muscle support part that supports a portion conforming to the serratus posterior inferior muscle of the person in the supine position, and a height of the serratus posterior inferior muscle support part is set to be same as a height of the spine support part, and hardness of the serratus posterior inferior muscle support part is set to be lower than hardness of the spine support part.

This configuration enables reducing body pressure from the serratus posterior inferior muscle support part while supporting the lumbar vertebrae and the thoracic vertebrae with the spine support part because the serratus posterior inferior muscle support part is softer than the spine support part. Accordingly, compression on the serratus posterior inferior muscle can be avoided.

The mat may be preferably configured as follows: the spine support part continuously supports a portion conforming to at least a section from the twelfth thoracic vertebra to the third lumbar vertebra of the spine, the back support part further includes a pair of quadratus lumborum muscle corresponding parts disposed on the widthwise both sides of the spine support part and disposed below respective portions conforming to a pair of left and right quadratus lumborum muscles of the person in the supine position, the mat further includes a pair of ilium support parts support a portion conforming to at least a widthwise outer section of an iliac crest in each of a pair of ilia of the pelvis of the person in the supine position separately from below, the pair of quadratus lumborum muscle corresponding parts and the spine support part are configured such that body pressure from the pair of quadratus lumborum muscle corresponding parts is lower than body pressure from the spine support part; and the pair of ilium support parts each include an upper surface lying at a position higher than an upper surface of a peripheral part of the ilium support in the back support part.

According to the configuration, the pair of quadratus lumborum muscle corresponding parts is provided below respective portions conforming to the pair of quadratus lumborum muscles of a person in a supine position, and the spine support part and the pair of quadratus lumborum muscle corresponding parts are configured such that the body pressure from the pair of quadratus lumborum muscle corresponding parts is lower than the body pressure from the spine support part. Accordingly, while the spine support part continuously supports a portion conforming to a section including at least the twelfth thoracic vertebra to the third lumbar vertebra of the spine, the body pressure from the quadratus lumborum muscle corresponding part can be reduced to lower than the body pressure from the spine support part. This configuration enables preventing the quadratus lumborum muscle corresponding part from compressing the quadratus lumborum muscle.

Additionally, the mat includes the pair of ilium support parts that supports a portion conforming to at least the widthwise outer section of the iliac crest in each of the pair of ilia of the pelvis of the person in the supine position separately from below, and the upper surface of the ilium support is disposed at a position higher than the upper surface of the peripheral part of the ilium support in the back support part. The quadratus lumborum muscle is connected at one end to the iliac crest, and thus the ilium support part supports the one end of the quadratus lumborum muscle at a position outside the quadratus lumborum muscle in a body side direction and higher than the quadratus lumborum muscle corresponding part. Thus, the pair of ilium support parts each can support a portion conforming to at least the widthwise outer section of the iliac crest in the ilium at a position higher than the peripheral part of the ilium support part, so that the quadratus lumborum muscle can be prevented from being compressed also by the ilium support.

Accordingly, the quadratus lumborum muscle can be prevented from being compressed by both the quadratus lumborum muscle corresponding part and the ilium support as described above, so that the quadratus lumborum muscle of a person in a supine position can be stabilized while a force in a direction of attracting the pair of ilia connected to respective one ends of the pair of quadratus lumborum muscles toward the front side of the person in the supine position during expiration without being disturbed by a repulsive force of the mat. Accordingly, the sacrum located between the pair of ilia in the pelvis can easily perform a so-called nodding motion in which the sacrum inclines toward the front side of the person in the supine position. Then, the diaphragm connected to the lumbar vertebrae and the thoracic vertebrae is likely to be relaxed along with the nodding motion of the sacrum. At the same time, the group of ribs can be lowered by the pair of quadratus lumborum muscles. Accordingly, expiration in the supine position can be further promoted.

The configuration above thus enables expiration to be more easily performed by effect of promoting expiration due to relaxation of compression on not only the serratus posterior inferior muscle using the serratus posterior inferior muscle corresponding part but also the quadratus lumborum muscle using the quadratus lumborum muscle corresponding part.

Each of the pair of quadratus lumborum muscle corresponding parts may be preferably formed in a region between an origin connected to ilium and an insertion connected to the twelfth rib in each of the pair of quadratus lumborum muscles, the region including a portion conforming to a section other than the origin and the insertion.

The quadratus lumborum muscle includes a section between the origin connected to the ilium and the insertion connected to the twelfth rib, and it is considerable that the section exclusively contributes to the stabilization of the ilium. Thus, the configuration above enables the ilium to be effectively stabilized while applying a force in a direction of attracting the ilium toward the front side by allowing the quadratus lumborum muscle corresponding part to effectively reduce body pressure of the section other than the origin connected to the ilium and the insertion connected to the twelfth rib in the quadratus lumborum muscle, thereby avoiding compression on the quadratus lumborum muscle, while a state in which the ilium is supported by the ilium support is maintained. Accordingly, the nodding motion of the sacrum and the relaxation of the diaphragm can be further promoted. At the same time, the group of ribs can be effectively lowered by the pair of quadratus lumborum muscles. Accordingly, expiration is further facilitated.

The quadratus lumborum muscle corresponding part may be preferably formed so as to overlap the serratus posterior inferior muscle corresponding part at a portion conforming to each of both left and right sides of the first lumbar vertebra and the second lumbar vertebra.

Both the serratus posterior inferior muscle and the quadratus lumborum muscle are connected to the first and second lumbar vertebrae and overlap each other near the first and second lumbar vertebrae. Then, the quadratus lumborum muscle corresponding part is formed overlapping the serratus posterior inferior muscle corresponding part at the portion conforming to each of both left and right sides of the first lumbar vertebra and the second lumbar vertebra as described above, so that compression on parts on the both left and right sides of the first and second lumbar vertebrae in the serratus posterior inferior muscle and the quadratus lumborum muscle can be reliably avoided, and thus further facilitating expiration.

The quadratus lumborum muscle corresponding part may be preferably defined by a recess formed in the back support part.

This configuration enables body pressure from the quadratus lumborum muscle corresponding part to be reliably reduced to lower than body pressure from the spine support part by allowing the spine support part to support a portion conforming to the lumbar vertebrae, and disposing a portion conforming to the quadratus lumborum muscle in the recess constituting the quadratus lumborum muscle corresponding part. Accordingly, compression on the quadratus lumborum muscle can be reliably avoided.

The quadratus lumborum muscle corresponding part may preferably include a quadratus lumborum muscle support part that supports a portion conforming to the quadratus lumborum muscle of the person in the supine position, a height of the quadratus lumborum muscle support part is set to be same as the height of the spine support part, and hardness of the quadratus lumborum muscle support part is set to be lower than hardness of the spine support part.

This configuration enables reducing body pressure from the quadratus lumborum muscle support part while supporting the lumbar vertebrae with the spine support part because the quadratus lumborum muscle support part is softer than the spine support part. Accordingly, compression on the quadratus lumborum muscle can be avoided.

The above mat may preferably further include a sacrum support part that is disposed on a leg side of the person in the supine position with respect to the spine support part to support a portion conforming to a sacrum of the person in the supine position, in which a height of the sacrum support part is set to be relatively lower than a height of the spine support part.

This configuration may further include the sacrum support part that supports the portion conforming to the sacrum of the person in the supine position, and a height of the sacrum support part is set to be relatively lower than a height of the spine support part. Accordingly, the sacrum can be turned in the forward direction toward the leg side during expiration, or a nodding motion can be performed, without being inhibited by reaction force (body pressure) from the sacrum support part. This configuration also enables smoothly performing the nodding motion of the sacrum while flexibly moving the entire spine continuous from the lumbar vertebrae to the thoracic vertebrae by allowing the spine support part to continuously support the portion conforming to the section including three or more continuous lumbar vertebrae and/or thoracic vertebrae in the region including the first lumbar vertebra and the twelfth thoracic vertebra as described above. When the sacrum performs the nodding motion, the diaphragm connected to the lumbar vertebra continuous to the sacrum moves in the direction toward the head of the person in the supine position, and thus further facilitating expiration. Accordingly, respiration in the supine position can be further promoted.

The above mat may be preferably configured such that the sacrum support part includes a placement surface that is continuous with the upper surface of the spine support part and inclined downward toward legs of the person in the supine position, and the placement surface continuously supports a portion conforming to at least a section of the sacrum of the person in the supine position from below, the section being on a head side of the person in the supine position, and a lumbar vertebra adjacent to the sacrum.

This configuration includes the sacrum support part with the placement surface inclined downward toward the legs of the person in the supine position continuously on the upper surface of the spine support part. Thus, this configuration enables the upper surface of the spine support part and the placement surface of the sacrum support part continuous to the upper surface to continuously support at least a region from the twelfth thoracic vertebra to the sacrum including all the lumbar vertebrae even when the sacrum nods in the forward direction, and thus enables supporting the region while dispersing body pressure using the surfaces in contact with a wide region of the portion conforming to the sacrum and the lumbar vertebrae. Accordingly, a load to be applied to the lumbar vertebrae connected to the sacrum can be further reduced.

The above mat may be preferably configured such that the back support part further includes a pair of outer support parts that is positioned widthwise outside of the pair of serratus posterior inferior muscle corresponding parts to support an outer part of the back, the outer section being widthwise outside of the serratus posterior inferior muscle.

This configuration includes the pair of outer support parts that is positioned widthwise outside of the pair of serratus posterior inferior muscle corresponding parts to support the outer section of the back, the outer section being widthwise outside the serratus posterior inferior muscle. Thus, even when the serratus posterior inferior muscle corresponding part avoids compression on the portion conforming to the serratus posterior inferior muscle, the back can be stably supported by the spine support part and the pair of outer support parts.

The mat of the present embodiment configured as described above can facilitate respiration in the supine position.

The invention claimed is:

1. A mat comprising:

a back support part that is configured to support a back of a person's body in a supine position, wherein the back support part includes:

a spine support part having a length that enables continuous support of a portion of a person's body corresponding to a section defined by three or more continuous lumbar vertebrae and thoracic vertebrae of a spine in the back of the person's body in the supine position, the section including at least a first lumbar vertebra and a twelfth thoracic vertebra; and serratus posterior inferior muscle corresponding parts which are on respective widthwise sides of the spine support part and configured to be below portions of the person's body corresponding to left and right serratus posterior inferior muscles of the person's body in the supine position, and wherein the serratus posterior inferior muscle corresponding parts and the spine support part are configured such that a first body pressure from the serratus posterior inferior muscle corresponding parts is lower than a second body pressure from the spine support part.

2. The mat according to claim 1, further comprising:

a sacrum support part that is configured to be disposed on a leg side of person's body in the supine position with respect to the spine support part for supporting a portion of the person's body corresponding to a sacrum of the person's body in the supine position, wherein a height of the sacrum support part is lower than a height of the spine support part.

3. The mat according to claim 2, wherein:

the sacrum support part includes a placement surface that is continuous with an upper surface of the spine support part and is configured to be inclined downward toward legs of the person's body in the supine position; and the placement surface is configured to continuously support a portion of the person's body corresponding to at least a section of the sacrum of the person's body in the supine position from below, the section being on a head side of the person's body in the supine position, and a lumbar vertebra adjacent to the sacrum.

4. The mat according to claim 1, wherein each of the serratus posterior inferior muscle corresponding parts is defined by a recess in the back support part.

5. The mat according to claim 1, wherein:

each of the serratus posterior inferior muscle corresponding parts includes a serratus posterior inferior muscle support part that is configured to support a portion of the person's body corresponding to one of the left or right serratus posterior inferior muscles of the person's body in the supine position; and a height of the serratus posterior inferior muscle support part is the same as a height of the spine support part, and a hardness of the serratus posterior inferior muscle support part is lower than a hardness of the spine support part.

6. The mat according to claim 1, wherein the back support part further includes outer support parts positioned widthwise outside of the serratus posterior inferior muscle corresponding parts, respectively, and configured to support at least an outer section of the back of the person's body, the outer section being widthwise outside of one of the left or right serratus posterior inferior muscles.

7. The mat according to claim 1, wherein each of the serratus posterior inferior muscle corresponding parts is in a region of the mat including at least a locality of a portion of the mat configured to correspond to a section where each of the serratus posterior inferior muscles joins a second lumbar vertebra.

8. The mat according to claim 7, wherein each of the serratus posterior inferior muscle corresponding parts is in a region of the mat being configured to have ½ or more of an area defined by projecting of each of the serratus posterior inferior muscles over an upper surface of the mat, the area covering the portion of the mat configured to correspond to the section where each of the serratus posterior inferior muscles joins the second lumbar vertebra.

9. The mat according to claim 7, wherein each of the serratus posterior inferior muscle corresponding parts is defined by a recess in the back support part.

10. The mat according to claim 7, wherein:

each of the serratus posterior inferior muscle corresponding parts includes a serratus posterior inferior muscle support part that is configured to support a portion of the person's body corresponding to one of the left or right serratus posterior inferior muscles of the person's body in the supine position; and a height of the serratus posterior inferior muscle support part is the same as a height of the spine support part, and a hardness of the serratus posterior inferior muscle support part is lower than a hardness of the spine support part.

11. The mat according to claim 7, wherein:

the spine support part is configured to continuously support a portion of the person's body corresponding to at least a section from the twelfth thoracic vertebra to the third lumbar vertebra of the spine;

the back support part further includes quadratus lumborum muscle corresponding parts on respective widthwise sides of the spine support part and configured to be below portions of the person's body corresponding to left and right quadratus lumborum muscles of the person's body in the supine position;

the mat further comprises ilium support parts configured to support a portion of the person's body corresponding to at least a widthwise outer section of an iliac crest in each of ilia of a pelvis of the person's body in the supine position separately from below;

the quadratus lumborum muscle corresponding parts and the spine support part are configured such that a third body pressure from the quadratus lumborum muscle corresponding parts is lower than the second body pressure from the spine support part; and each of the ilium support parts includes an upper surface at a position higher than an upper surface of a peripheral part of the ilium support parts in the back support part.

12. The mat according to claim 1, wherein:

the spine support part is configured to continuously support a portion of the person's body corresponding to at least a section from the twelfth thoracic vertebra to the third lumbar vertebra of the spine;

the back support part further includes quadratus lumborum muscle corresponding parts on respective widthwise sides of the spine support part and configured to be below portions of the person's body corresponding to left and right quadratus lumborum muscles of the person's body in the supine position;

the mat further comprises ilium support parts configured to support a portion of the person's body corresponding to at least a widthwise outer section of an iliac crest in each of ilia of a pelvis of the person's body in the supine position separately from below;

the quadratus lumborum muscle corresponding parts and the spine support part are configured such that a third body pressure from the quadratus lumborum muscle corresponding parts is lower than the second body pressure from the spine support part; and each of the ilium support parts includes an upper surface at a position higher than an upper surface of a peripheral part of the ilium support parts in the back support part.

13. The mat according to claim 12, wherein the quadratus lumborum muscle corresponding parts overlap the serratus posterior inferior muscle corresponding parts, respectively, at portions of the mat configured to correspond left and right sides of the first lumbar vertebra and a second lumbar vertebra.

14. The mat according to claim 12, wherein each of the quadratus lumborum muscle corresponding parts is defined by a recess in the back support part.

15. The mat according to claim 12, wherein:

each of the quadratus lumborum muscle corresponding parts includes a quadratus lumborum muscle support part that is configured to support a portion of the person's body corresponding to one of the left or right quadratus lumborum muscles of the person;

a height of the quadratus lumborum muscle support part is the same as a height of the spine support part; and a hardness of the quadratus lumborum muscle support part is lower than hardness of the spine support part.

16. The mat according to claim 12, wherein each of the quadratus lumborum muscle corresponding parts is in a region of the mat being configured to be between an origin connected to one of the ilia and an insertion connected to a twelfth rib in each of the left and right quadratus lumborum muscles, the region including a portion of the mat configured to correspond to a section other than the origin and the insertion.

17. The mat according to claim 16, wherein the quadratus lumborum muscle corresponding parts overlap the serratus posterior inferior muscle corresponding parts, respectively, at portions of the mat configured to correspond left and right sides of the first lumbar vertebra and a second lumbar vertebra.

18. The mat according to claim 16, wherein each of the quadratus lumborum muscle corresponding parts is defined by a recess in the back support part.

19. The mat according to claim 16, wherein:

each of the quadratus lumborum muscle corresponding parts includes a quadratus lumborum muscle support part that is configured to support a portion of the person's body corresponding to one of the left or right quadratus lumborum muscles of the person's body in the supine position;

a height of the quadratus lumborum muscle support part is the same as a height of the spine support part; and a hardness of the quadratus lumborum muscle support part is lower than hardness of the spine support part.

* * * * *